US006550457B1

(12) United States Patent
Kitagawa et al.

(10) Patent No.: US 6,550,457 B1
(45) Date of Patent: Apr. 22, 2003

(54) ELECTRONIC FUEL INJECTION CONTROL APPARATUS FOR INTERNAL COMBUSTION ENGINE

(75) Inventors: Yuichi Kitagawa, Numazu (JP); Kazuyoshi Kishibata, Numazu (JP); Hiroyasu Sato, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/259,065

(22) Filed: Sep. 27, 2002

(30) Foreign Application Priority Data

Sep. 28, 2001 (JP) ..... 2001-299404

(51) Int. Cl.[7] ..... F02M 51/00

(52) U.S. Cl. ..... 123/486; 123/492; 701/105; 701/115

(58) Field of Search ..... 123/486, 492, 123/472, 434; 701/105, 115

(56) References Cited

U.S. PATENT DOCUMENTS 4,497,301 A * 2/1985 Inoue et al. ..... 123/486

FOREIGN PATENT DOCUMENTS

JP 63-205438 8/1988
JP 60-035145 2/1995

* cited by examiner

*Primary Examiner*—Bibhu Mohanty
(74) *Attorney, Agent, or Firm*—Pearne & Gordon LLP

(57) ABSTRACT

An electronic fuel injection control apparatus for an internal combustion engine, which is used for controlling a quantity of fuel injected from an injector into an intake pipe of the internal combustion engine, includes a microcomputer which performs an arithmetical operation for determining a pressure within the above described intake pipe based on a throttle valve opening degree and a rotational speed, an arithmetical operation for determining a variation relative to an arithmetically operated reference value of the intake pipe pressure, an arithmetical operation for determining a correction coefficient used for correcting an injection time when this variation exceeds a set value, and an arithmetical operation for determining an actual injection time by multiplying a basic injection time by the correction coefficient arithmetically operated immediately before a timing where the fuel is injected, and controls the injector such that the fuel is injected during the arithmetically operated injection time.

33 Claims, 10 Drawing Sheets

Vp2

PULSER OUTPUT
Vp1

INJECTION COMMAND SIGNAL Vj

THROTTLE OPENING DEGREE θ

INTAKE PRESSURE MAP RETRIEVAL VALUE PBmap
⊿PBmap
⊿PBmap
⊿PBmap
⊿PBmap
⊿PBmap

COMPARATIVE REFERENCE VALUE PBmapo
ti1
ti2
ti3
ti4
ti5
t

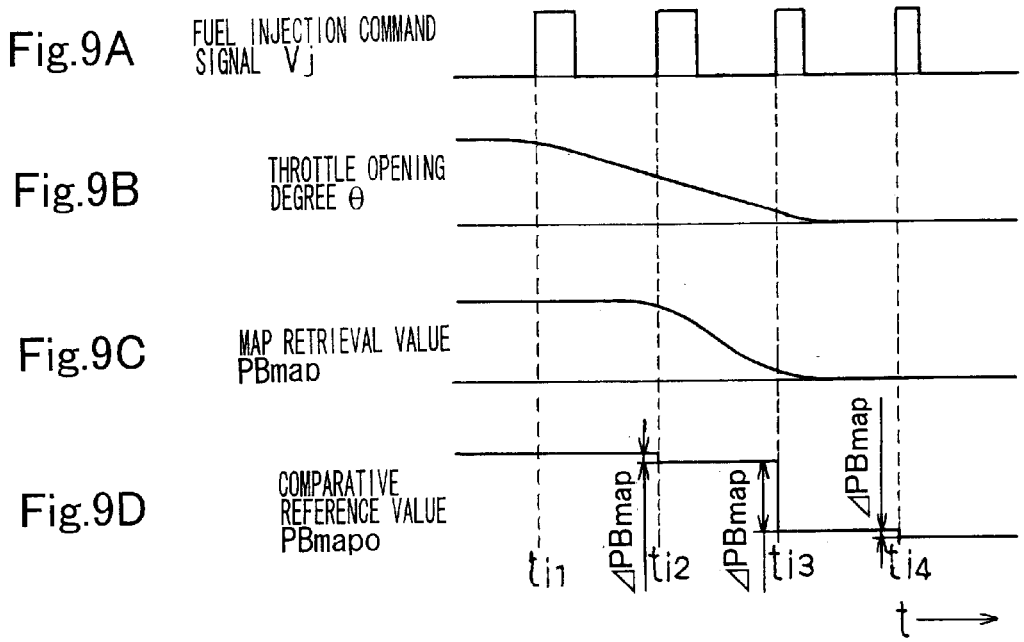
Fig.9A
FUEL INJECTION COMMAND SIGNAL Vj
Fig.9B
THROTTLE OPENING DEGREE θ
Fig.9C
MAP RETRIEVAL VALUE PBmap
Fig.9D
COMPARATIVE REFERENCE VALUE PBmapo
ΔPBmap
ΔPBmap
ΔPBmap
ti1
ti2
ti3
ti4
t
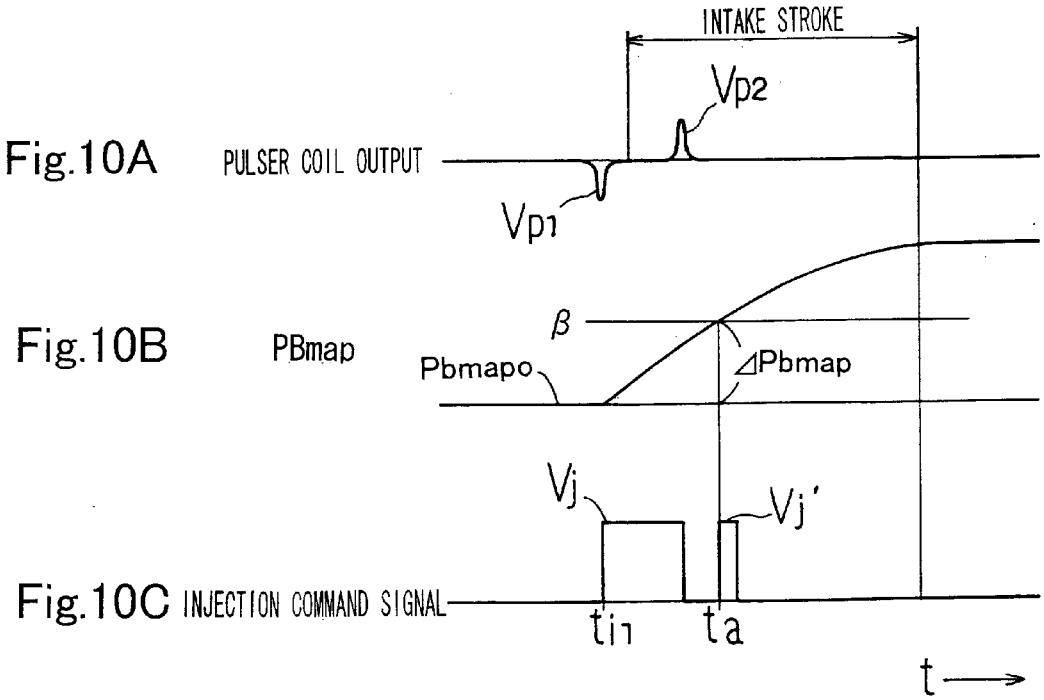
INTAKE STROKE
Vp2
Fig.10A
PULSER COIL OUTPUT
Vp1
Fig.10B
PBmap
β
Pbmapo
ΔPbmap
Vj
Vj'
Fig.10C
INJECTION COMMAND SIGNAL
ti1
ta
t

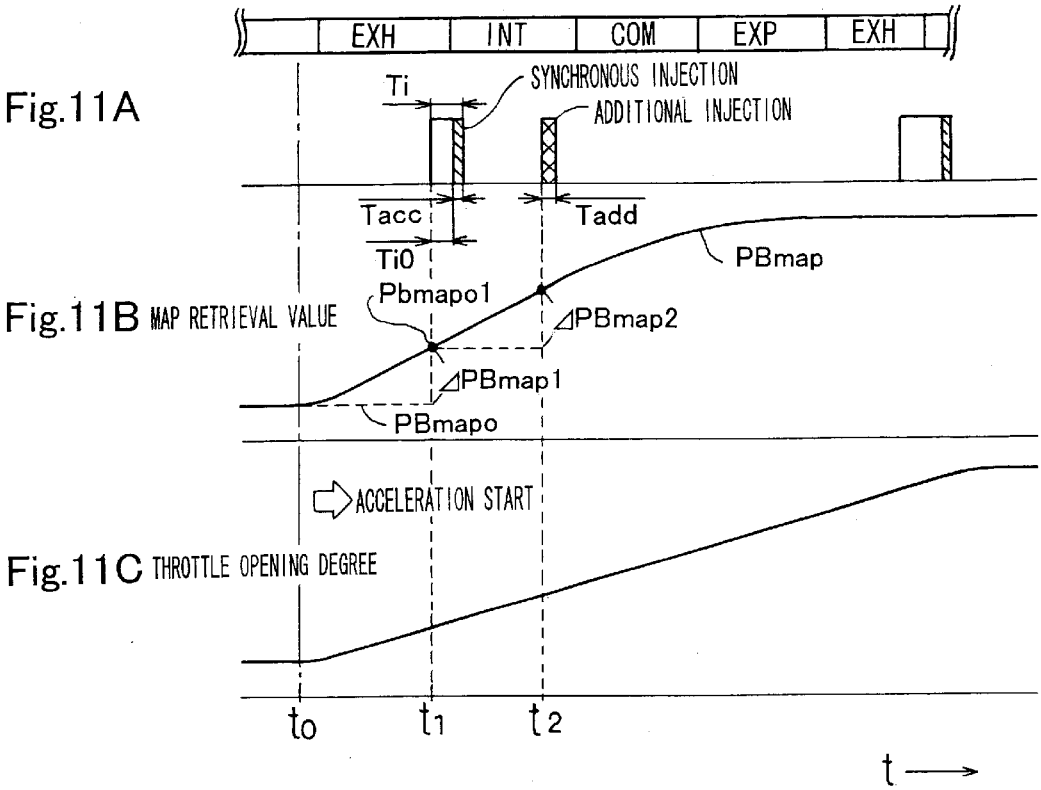
EXH
INT
COM
EXP
EXH
Fig.11A
Ti
SYNCHRONOUS INJECTION
ADDITIONAL INJECTION
Tacc
Tadd
Ti0
PBmap
Fig.11B MAP RETRIEVAL VALUE
Pbmapo1
PBmap2
PBmap1
PBmapo
ACCELERATION START
Fig.11C THROTTLE OPENING DEGREE
t0
t1
t2
t
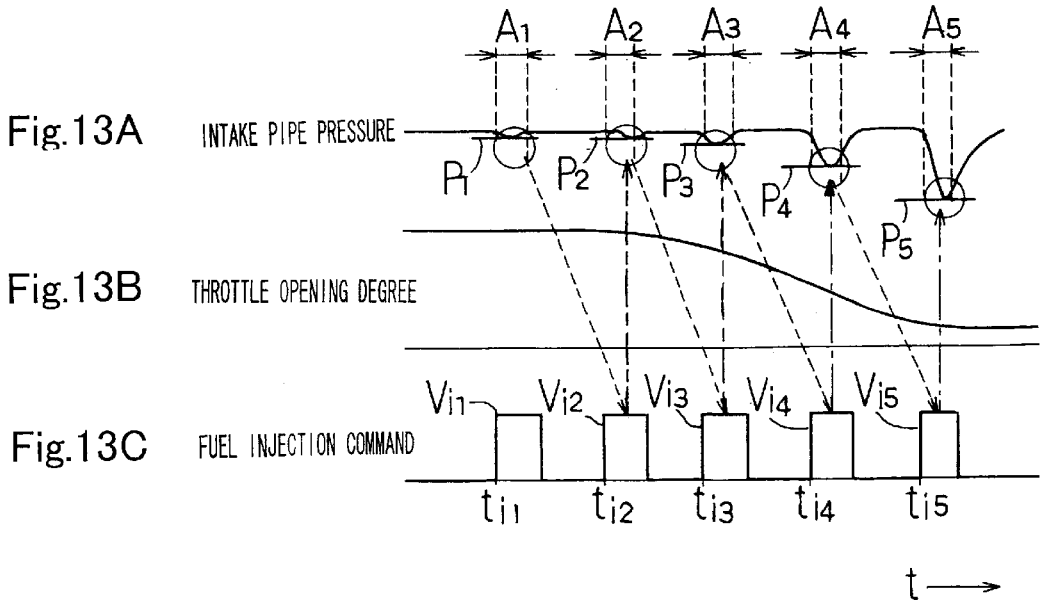
A1
A2
A3
A4
A5
Fig.13A
INTAKE PIPE PRESSURE
P1
P2
P3
P4
P5
Fig.13B
THROTTLE OPENING DEGREE
Vi1
Vi2
Vi3
Vi4
Vi5
Fig.13C
FUEL INJECTION COMMAND
ti1
ti2
ti3
ti4
ti5
t ATMOSPHERIC PRESSURE
INTAKE PIPE PRESSURE
NEGATIVE PRESSURE
A1
A2
A3
A4
ACCELERATION START
P1
P2
P3
P4

THROTTLE OPENING DEGREE

FUEL INJECTION COMMAND
Vi1
Vi2
Vi3
Vi4
ti1
ti2
ti3
ti4
t

ELECTRONIC FUEL INJECTION CONTROL APPARATUS FOR INTERNAL COMBUSTION ENGINE

TECHNICAL FIELD OF THE INVENTION

The present invention relates to an electronic fuel injection control apparatus for controlling a quantity of fuel injected from an injector into an internal combustion engine for driving a vehicle.

BACKGROUND OF THE INVENTION

When an injector(an electromagnetic fuel injection valve), which is mounted on an intake pipe of an engine for example, is used as means for supplying fuel to an internal combustion engine, an injection quantity of the fuel from the injector is controlled by an electronic fuel injection control apparatus (EFI).

Since the injection quantity of the fuel from the injector is required to be determined such that an air-fuel ratio of a mixture supplied to the engine is kept within a predetermined range, it is necessary to estimate an amount of intake air which is sucked into a cylinder during an intake stroke when the fuel injection quantity is determined.

As a method for estimating the amount of intake air which is sucked into the cylinder during the intake stroke of a four-cycle internal combustion engine, a speed-density system has been widely adopted. In the speed-density system which comprises an intake pressure sensor for detecting a pressure at a downstream side of a throttle valve within the intake pipe as an intake pipe pressure (a negative pressure) and speed detecting means for detecting a rotational speed of the engine, the intake air amount is estimated from the intake pipe pressure detected by the intake pressure sensor, the rotational speed of the engine, and an volumetric efficiency of the engine, then the fuel injection quantity to be required is arithmetically operated for obtaining a predetermined air-fuel ratio based on the intake air amount.

The injector opens its valve when a drive current is provided thereto, and injects the fuel provided from a fuel pump into the intake pipe. Generally, a pressure of fuel provided to an injector is kept constantly by a pressure regulator, so that the injection quantity of the fuel from the injector is determined in accordance with a time (a fuel injection time) during which the injector valve is opened. Therefore, in the electronic fuel injection control apparatus, the fuel injection quantity is arithmetically operated as a fuel injection time, then the injector is driven so that the fuel is injected over the arithmetical operation period of time for fuel injection.

FIG. 12, which relates to a four-cycle single cylinder internal combustion engine, shows a change in an intake pipe pressure and a change in an opening degree of the throttle valve relative to a time t when the engine is accelerated, and also shows a change in a fuel injection command signal provided to the injector relative to a time t. In FIG. 12, each of A1 to A4 denotes a period of time during which the engine is on the intake stroke, and Vi1 to Vi4 respectively denote fuel injection command signals provided to an injector drive circuit at a timing ti1 to ti4 of starting the fuel injection during the intake strokes A1 to A4. Width of the injection command signal corresponds to a fuel injection time. The injector drive circuit supplies the drive current to the injector as long as the injection command signals are provided, and then allows the fuel to be injected from the injector.

An actual injector opens its valve to start the fuel injection when the drive current exceeds a predetermined valve opening current value, so that a time width of the injection command signal is not exactly equal to the fuel injection time. However, in this specification, the time width of the injection command signal is taken as the fuel injection time, for the sake of simplicity.

As shown in FIG. 12A, an intake pipe pressure of the four-cycle single cylinder internal combustion engine significantly decreases during the intake stroke, and the intake pipe pressure becomes a minimum at the end of the intake stroke. In an example shown in FIG. 12A, respective minimum values of pressures within the intake pipe during the intake strokes A1 to A4 are P1 to P4, respectively.

In the example shown in FIG. 12, an operation for accelerating the engine is conducted immediately before starting an intake stroke A3, wherein an opening degree of the throttle valve is increased. At a state before conducting the accelerating operation, the opening degree of the throttle valve is kept substantially constant. In this case, minimum values of the intake pipe pressure are substantially constant as represented by P1 and P2, provided that a load does not change. On the contrary, when the accelerating operation is conducted and the opening degree of the throttle valve increases, the intake air amount also increases. Therefore, a minimum value of the intake pipe pressure becomes higher with increase in the opening degree of the throttle valve, as represented by P3 and P4.

FIG. 13, which relates to the four-cycle single cylinder internal combustion engine, shows changes in an intake pipe pressure and in an opening degree of the throttle valve relative to a time t when the engine is decelerated, and also shows a change in a fuel injection command signal provided to the injector relative to a time t. In FIG. 13, each of A1 to A4 denotes a period of time during which the engine is on the intake stroke. And Vi1 to Vi4 respectively denote fuel injection command signals provided to the injector drive circuit at a timing ti1 to ti4 of starting the fuel injection during the intake strokes A1 to A4.

In an example shown in FIG. 13, an operation for decelerating the engine is conducted immediately after completing an intake stroke A2, wherein an opening degree of the throttle valve is decreased. At a state before conducting the decelerating operation, the opening degree of the throttle valve is kept substantially constant. In this case, minimum values of the intake pipe pressure are substantially constant, provided that a load does not change. However, when the decelerating operation is conducted and the opening degree of the throttle valve decreases, the intake air amount also decreases. Therefore, a minimum value of the intake pipe pressure becomes lower with decrease in the opening degree of the throttle valve, as represented by P3, P4, and P5 (an absolute value of the negative pressure will become larger).

In an speed-density type of EFI internal combustion engine, a basic injection time for injecting fuel at each intake stroke is arithmetically operated based on an intake air amount, which has been estimated from an intake pipe pressure and a rotational speed detected during the previous intake stroke, and various control conditions. In a single cylinder internal combustion engine or in a multi-cylinder internal combustion engine which has an intake pipe mounted on each cylinder, wherein an intake pipe pressure has a minimum value, the minimum value detected during the previous intake stroke is used as a value of the intake pipe pressure to be used for estimating the intake air amount.

In an example shown in FIG. 12 for example, a basic injection time for injecting fuel at an intake stroke A2 is arithmetically operated from an intake air amount which has been estimated from a minimum value P1 of an intake pipe pressure and a rotational speed detected during an intake stroke A1. Similarly, basic injection times for injecting fuel at intake strokes A3 and A4 (injection times at a steady operation) respectively are arithmetically operated from respective intake air amounts which have been estimated from minimum values P2 and P3 of pressures within an intake pipe and respective rotational speeds detected during intake strokes A2 and A3. The same is true of an example shown in FIG. 13.

When an opening degree of the throttle valve is maintained substantially constant or when an opening degree of the throttle valve is gradually changed, a difference between an intake air amount during the previous intake stroke which has been used for arithmetically operating the basic injection time and an intake air amount during the present intake stroke does not become larger, so that there is no problem even if the basic injection time arithmetically operated as described above is used as it is as an actual injection time.

However, when an opening degree of the throttle valve is sharply increased when the engine is accelerated, a difference between an intake pipe pressure at a time of arithmetically operating the basic injection time and an intake pipe pressure at a time of actually injecting fuel becomes larger. Therefore, if the basic injection time arithmetically operated as described above is used as it is as the actual injection time, the injected fuel quantity is insufficient and an air-fuel ratio becomes leaner. In an example shown in FIG. 12, a minimum value of an intake pipe pressure during an intake stroke A3 after performing an accelerating operation is extremely larger than a minimum value of an intake pipe pressure during the previous intake stroke A2, hence an intake air amount increases accordingly. Therefore, if an injection time during the intake stroke A3 is arithmetically operated based on the intake air amount which has been estimated from the minimum value of the intake pipe pressure detected during the intake stroke A2, the injected fuel quantity becomes significantly insufficient and an air-fuel ratio becomes leaner.

When the engine enters into its accelerated state, an intake pipe pressure increases and an evaporation rate of fuel decreases, so that a ratio of a fuel deposited on a wall of the intake pipe to a total injected fuel also increases. Therefore, the air-fuel ratio becomes leaner.

It is not preferable that the air-fuel ratio becomes leaner at a time of accelerating the engine, since components of the exhaust gas may deteriorate or running performance may decrease. Thus, in the electronically controlled fuel injection control apparatus which adopts the speed-density system, an increment correction of the fuel injection amount is made at a time of accelerating the engine in order to compensate for a shortfall of fuel.

In an electronic fuel injection control apparatus described in Japanese Patent Examined Application Laid-Open Publication No. 6-25549 for example, a rotational speed of an engine and an opening degree of a throttle valve are detected, an increment correction amount is arithmetically operated based on the rotational speed and the opening degree of the throttle valve, and timing of starting this increment correction is determined from changes in the opening degree of the throttle valve. In this way, the increment correction is made. When it is detected that the intake pipe pressure hardly changes, this increment correction is completed.

In contrast to this, if the throttle valve is abruptly closed at a time of decelerating the engine, an amount of the fuel excessively increases and a air-fuel ratio becomes richer.

For example, when the throttle valve is opened as shown in FIG. 13, a decrease in the intake pipe pressure is small as shown in the intake stroke A1 or A2. However, when the throttle valve is abruptly closed from this opening state, an amount of air amounting into a cylinder of the engine decreases and the intake pipe pressure also decreases. In this Figure, an intake air amount during an intake stroke A4 significantly decreases compared with that during an intake stroke A3, and an intake air amount during an intake stroke A5 further decreases compared with that during the intake stroke A4. Therefore, if the respective injection times during the intake strokes A4 and A5 are arithmetically operated based on intake air amounts which have been estimated from minimum values of the intake pipe pressure detected during the intake strokes A3 and A4 respectively as conducted by the conventional control device, the fuel injection quantity excessively increases and the air-fuel ration becomes leaner.

When the engine enters into its decelerated state, an intake pipe pressure decreases (an absolute value of the negative pressure will become larger) and an evaporation rate of fuel increases, so that almost all fuel injected are evaporated and a portion of the fuel deposited on a wall of the intake pipe is also evaporated. Therefore, the air-fuel ratio becomes richer.

When the air-fuel ratio becomes richer at the time of decelerating the engine as described above, the components of the exhaust gas may deteriorate or running performance may decrease. Thus, in the electronically controlled fuel injection control apparatus which adopts the speed-density system, a decrement correction of the fuel injection quantity is made at a time of decelerating the engine in order to prevent the fuel from being excessively increased.

In a fuel injection control apparatus described in Japanese Patent Examined Application Laid-Open Publication No. 7-13490 for example, the decrement correction is made by detecting from a rate of change of throttle valve opening degree that an operation for decelerating the engine is conducted.

As for the internal combustion engines for driving vehicles, a load on the engine may be abruptly increased and a minimum value of the intake pipe pressure may be raised and further an evaporation rate of the fuel may be decreased due to a clutch control, a steep change in a gradient of road surface, or changes in a condition of road surface, despite the opening degree of the throttle valve being maintained constant. Even when the minimum value of the intake pipe pressure is increased without changing the opening degree of the throttle valves described above, the air-fuel ratio becomes leaner by a synergistic effect of a decrease in the evaporation rate and a delay in the detection of the intake pipe pressure. However, in this case, the increment correction can not be made by a method for correcting the increments of the fuel injection quantity which has been adopted in the conventional electronic fuel injection control apparatus, since the opening degree of the throttle valve is constant.

In an internal combustion engine which employs the electronic fuel injection control apparatus whose rotational speed detected is constant (3000 [r/min.] for example), considering one case where it is detected that a throttle valve opening degree changes by 10° from 5° to 15° and the other case where it is detected that a throttle valve opening degree changes by 10° from 50° to 60°, the former requires to be more corrected in order to increase the fuel injection quantity because an accelerating operation has been conducted from its light-load state where a load is hardly applied thereto and consequently an intake pipe pressure largely changes. On the other hand, in the latter case, it is hardly necessary to perform the increment correction because the engine is already in a high-load state at a time of accelerating the engine and an intake pipe pressure is close to an atmospheric pressure.

However, in the conventional apparatus, a correction amount of the fuel injection quantity at a time of accelerating the engine is determined from a rotational speed of the engine and a rate of change of the throttle valve opening degree as described above. Therefore, the increment correction of the fuel injection quantity at the time of accelerating the engine is made by the same amount under the condition that the rotational speed is constant, whether the throttle valve opening degree is changed from 5° to 15° (a variation amount is +10°) or the throttle valve opening degree is changed from 50° to 60° (a variation amount is +10°). Thus, there has been a problem that an unreasonable control is exercised.

In some conventional electronic fuel injection control apparatus, an increment correction of the fuel injection quantity is made by increasing the respective injection times of a plurality of fuel injections which are continuously performed after the detection of the acceleration state larger than the basic injection time. In this kind of conventional-control apparatus, an injection quantity at a time of the first fuel injection which is performed after detecting its accelerating state is increased, then increments of the fuel is gradually decreased during the plurality of the fuel injections which are performed continuously. Finally, the increments of the fuel become zero.

However, in the above described control, if the throttle valve is operated at a time of accelerating the engine such that an opening degree of the throttle valve is gradually increased at a start of the operation and then is sharply increased from the middle of the operation, the fuel injection quantity can not be increased in response to the sharp increase in the opening degree of the throttle valve. Therefore, the injection amount of fuel may become insufficient and the air-fuel ratio may become leaner.

In the internal combustion engines for driving vehicles, a load on the engine may be abruptly decreased and an intake pipe pressure may also be decreased and further an evaporation rate of the fuel may be increased due to a clutch control, a steep change in a gradient of road surface, changes in a condition of road surface, or slipping of wheels at a time of jumping, despite the opening degree of the throttle valve being maintained constant. In addition to the case where the throttle valve is suddenly closed, even when the intake pipe pressure decreases due to a sharp decrease in the load applied thereto without changing the throttle valve opening degree as described above, the air-fuel ratio becomes richer by a synergistic effect of an increase in the evaporation rate and a delay in the detection of the intake pipe pressure. In this case, the decrement correction of the fuel injection quantity can not be made by a method for correcting the decrements of the fuel injection quantity which has been used for the conventional electronic fuel injection control apparatus, since the opening degree of the throttle valve is constant.

SUMMARY OF THE INVENTION

In view of the above described problems, an object of the present invention is to provide an electronic fuel injection control apparatus which allows for prevention of excess and deficiency of an injection quantity caused by a delay in detection of an intake pipe pressure at a time of decelerating and accelerating an engine.

Another object of the present invention is to provide an electronic fuel injection control apparatus which can precisely correct an injection quantity in any of the cases where an engine is accelerated in its light-load state, where an engine is accelerated in its high-load state, and where an engine is abruptly decelerated.

Another object of the present invention is to provide an electronic fuel injection control apparatus which can precisely correct a fuel injection quantity, even when a load applied to an engine is changed under the condition that a throttle valve opening degree is substantially constant.

The present invention is applied to an electronic fuel injection control apparatus, comprising: an injector for injecting fuel into an intake pipe of an internal combustion engine; intake air amount arithmetical operation means for arithmetically operating an intake air amount from an intake pipe pressure of the above described internal combustion engine and a rotational speed of the internal combustion engine; basic injection time arithmetical operation means for arithmetically operating a basic injection time of fuel based on the intake air amount; correction variable arithmetical operation means for arithmetically operating a correction variable which is used for determining an actual injection time by performing a correction operation on the basic injection time; synchronous injection control means for performing an actual injection time processing, in which the actual injection time is arithmetically operated by performing the correction operation using the correction variable arithmetically operated by the correction variable arithmetical operation means at every time a predetermined synchronous injection timing is detected, and for performing a processing in which the synchronous injection is effected by actuating the injector during the arithmetically operated actual injection time.

The present invention comprises: load detecting parameter map storing means for storing a load detecting parameter map which provides a relation among a load detecting parameter which varies depending on a change in a load applied to an internal combustion engine, a throttle valve opening degree of the internal combustion engine, and a rotational speed of the internal combustion engine; map retrieval means for arithmetically operating a map retrieval value on a load detecting parameter map, based on the throttle valve opening degree of the internal combustion engine and the rotational speed of the internal combustion engine, at least at each synchronous injection timing or at the immediately preceding timing; and map retrieval value variation arithmetical operation means in which, at every time the map retrieval value is arithmetically operated by the map retrieval means, the map retrieval value obtained by the map retrieval means at the previous synchronous injection timing or at the immediately preceding timing is used as a comparative reference value and a difference between a map retrieval value newly obtained by the map retrieval means and the comparative reference value is arithmetically operated as a map retrieval value variation.

The above described correction variable arithmetical operation means is comprised such that the correction variable is arithmetically operated relative to the map retrieval value variation when the map retrieval value variation obtained at the synchronous injection timing or the immediately preceding timing exceeds a set value, and the synchronous injection control means is comprised such that the actual injection time processing is performed by using the correction variable obtained by the correction variable arithmetical operation means at the synchronous injection timing or the immediately preceding timing.

The above described correction variable is a variable used for the correction arithmetical operation performed on the basic injection time, and varies depending on the map retrieval value variation which varies depending on a loaded condition of the engine. This correction valuable may be a coefficient by which the basic injection time is multiplied or may be a correction amount which is added to the basic injection time or subtracted from the basic injection time. That is, the correction arithmetical operation performed on the basic injection time for determining the actual injection time may be an arithmetical operation of multiplying the basic injection time by the correction coefficient (the correction variable) or may be an arithmetical operation of adding the correction amount (the correction variable) to the basic injection time or subtracting the correction amount from the basic injection time.

The parameter for detecting the load is a parameter which varies depending on the load applied to the engine, so that the intake pipe pressure, the basic injection time of fuel (the basic injection time), an output torque or the like can be used as this parameter as described below.

The parameter for detecting the load significantly changes when the opening degree of the throttle valve is changed, when the rotational speed is reduced due to an increase in the load on the engine despite the opening degree of the throttle valve being substantially constant, or when the rotational speed is increased due to an decrease in the load on the engine despite the opening degree of the throttle valve being substantially constant. Consequently, the above described retrieval value variation becomes significantly larger when the engine is accelerated or decelerated, or when the rotational speed decreases or increases due to the increase or decrease in the load applied to the engine.

Arithmetically operating the map retrieval value based on the opening degree of the throttle valve and the rotational speed of the engine as described above, a map retrieval value can be obtained which corresponds to a load on the engine predicted from the throttle valve opening degree of the engine and the rotational speed of the engine at a time of the map retrieval. The map retrieval value becomes significantly larger with an increase in the load on the engine when the opening degree of the throttle valve is increased for accelerating the engine or when the load on the engine increases under the condition that the opening degree of the throttle valve is substantially constant (when the rotational speed is reduced despite the opening degree of the throttle valve being constant), for example. On the other hand, the above described map retrieval value becomes smaller when the opening degree of the throttle valve is decreased for decelerating the engine or when the load on the engine decreases under the condition that the opening degree of the throttle valve is substantially constant.

Thus, determining a difference between the map retrieval value and a comparative reference value (a map retrieval value obtained at a timing immediately before the fuel injection which is performed at the previous synchronous injection timing) as a map retrieval value variation as described above, it becomes possible to determine from a sign (positive or negative) of the map retrieval value variation whether the engine is in an acceleration condition or in a deceleration condition, and further, it also becomes possible to precisely detect an loaded condition of the engine in which the fuel injection quantity is requires to be increased or decreased. Therefore, if it is determined whether the fuel should be increased or decreased based on the sign of the map retrieval value variation and also it is detected that the magnitude of the map retrieval value variation exceeds the set value, it becomes possible to precisely determine the correction variable which is used for arithmetically operating the actual injection time consistent with the loaded condition at each moment of the engine, by arithmetically operating the correction variable relative to the map retrieval value variation.

Therefore, in the present invention as described above, the correction variable obtained at each synchronous injection timing or the immediately preceding timing is used as a correction variable which is used for arithmetically operating the actual fuel injection quantity, then the correction arithmetical operation is performed on the basic injection time by using this correction variable in order to determine the actual injection time. The basic injection time in each stroke is arithmetically operated by using an intake air amount which has been estimated based on an intake pipe pressure detected by a sensor during the previous intake stroke. In this way, a fuel injection quantity at each synchronous injection timing is corrected to a proper injection quantity which reflects changes in the loaded condition of the engine estimated at the synchronous injection timing or the immediately preceding timing. Consequently, it is possible to prevent the air-fuel ratio of the gaseous mixture from becoming leaner or richer due to excess and deficiency of the fuel injection quantity caused by the delay in detecting the intake air amount at a time of accelerating or decelerating the engine or at a time of increasing or decreasing the load.

In order to perform the above described control, it is necessary to perform an arithmetical operation for determining the correction variable by the correction variable determination means at the synchronous injection timing or at the immediately preceding timing. To this end, arithmetical operations of the map retrieval value, the map retrieval value variation, and the correction variable may be performed when the synchronous injection timing is detected, for example. Also, the correction variable which has been arithmetically operated at a timing immediately before detecting the synchronous injection timing may be used as a correction variable which is used for arithmetically operating the actual injection time of the synchronous injection by repeatedly performing the arithmetical operations of the map retrieval value, the map retrieval value variation, and the correction variable at very close time intervals (2 msec. intervals, for example).

In the present invention, it is also possible to perform an asynchronous injection such that fuel is injected at any time when it is detected that an injection quantity is insufficient after performing the synchronous injection at a predetermined timing. This asynchronous injection is immediately performed when a deficiency of fuel is detected after the synchronous injection is performed under the condition that a crank angle position is within a range where the fuel injection is permitted.

In the case where the synchronous injection and the asynchronous injection are performed, an electronic fuel injection control apparatus according to the present invention comprises, in addition to load detecting parameter map storing means, map retrieval means, and map retrieval value variation arithmetical operation means which are comprised as described above: asynchronous injection permitting crank angle determination means for determining whether or not a present crank angle position of the internal combustion engine is at a crank angle position where the asynchronous injection is permitted; asynchronous injection time arithmetical operation means for arithmetically operating an asynchronous injection time which is required for making up for a deficiency of fuel when it is detected that the fuel is insufficient after the synchronous injection timing; and asynchronous injection processing means for actuating an injector in order to inject fuel from the injector during the arithmetically operated asynchronous injection time, when the asynchronous injection time arithmetical operation means arithmetically operates the asynchronous injection time after completing the synchronous injection and when it is detected by the asynchronous injection permitting crank angle determination means that the present crank angle position is at a position permitting the asynchronous injection.

In this case, the map retrieval means is comprised such that map retrieval values are arithmetically operated repeatedly at very close time intervals during a time period where the asynchronous injection is permitted at least after completing the synchronous injection and, on the other hand, map retrieval values are arithmetically operated at least at the synchronous injection timing or at the immediately preceding timing during the other time of period. The asynchronous injection time arithmetical operation means is comprised such that the asynchronous injection time is arithmetically operated when it is detected that the map retrieval value variation obtained at the very close time intervals reaches a preset asynchronous determination value. The rest is the same as a case where the asynchronous injection is not performed.

Performing the asynchronous injection at any time when the deficiency of fuel is detected after the synchronous injection as described above, the deficiency of fuel can be immediately made up by the asynchronous injection when the fuel becomes insufficient due to a continuous increase in the opening degree of the throttle valve during a time period where the injected fuel is sucked into a cylinder of the engine after the synchronous injection. Therefore, the air-fuel ratio is prevented from becoming leaner and the running performance of the engine can be improved.

In the electronic fuel injection control apparatus according to the present invention, it is also possible to simultaneously perform the synchronous injection and an additional injection described below in order to prevent the excess and deficiency of fuel which may be caused by a change in the opening degree of the throttle valve and a change in the load after performing the synchronous injection.

The additional injection is performed when the fuel is insufficient at an additional injection timing which is set at a timing immediately before a timing where a time of period for sucking the fuel injected during the intake stroke of the internal engine into the cylinder of the internal combustion engine is completed (at the same timing every time).

In the case where the synchronous injection and the additional injection are performed as described above, the present invention comprises, in addition to load detecting parameter map storing means, map retrieval means, and map retrieval value variation arithmetical operation means which are comprised as described above: additional injection timing detection means for detecting an additional injection timing which has been set at an end of an intake stroke of the internal combustion engine; additional injection time arithmetical operation means for arithmetically operating an additional injection time required for making up for a deficiency of fuel after the beginning of the synchronous injection based on the map retrieval value variation when the latest map retrieval value variation obtained from the map retrieval value variation arithmetical operation means exceeds a preset additional injection determination value; and additional injection processing means for performing processing in order to additionally inject the fuel from an injector during the additional injection time which has been arithmetically operated by the additional injection time arithmetical operation means when the additional injection timing is detected.

In this case, the map retrieval means is comprised such that map retrieval values on the load detecting parameter map are arithmetically operated based on the opening degree of the throttle valve of the internal combustion engine and the rotational speed of the internal combustion engine at least at the synchronous injection timing or the immediately preceding timing and at the additional injection timing or the immediately preceding timing.

The additional injection timing is set at a timing which is before a timing where an intake stroke of the engine is completed such that the additionally injected fuel flows into a cylinder of the internal combustion engine. The rest is the same as a case where the additional injection is not performed.

Preferably, the above described additional injection time arithmetical operation means is comprised such that the additional injection time is arithmetically operated only when the map retrieval value variation exceeds a set value and when the above described rotational speed is less than a set rotational speed and the opening degree of the throttle valve is not less than the additional injection determination value.

Performing the additional injection as described above, the deficiency of fuel, which is caused by continuously opening the throttle valve during a period from the beginning of the synchronous injection to the completion of the intake stroke, can be made up at the last moment of the completion of the intake stroke. Therefore, it becomes possible to prevent the air-fuel ratio from becoming leaner due to the deficiency of fuel at a time of accelerating the engine.

Determining an injection quantity at the additional injection time by estimating a loaded condition of the engine based on a variation of the map value retrieved at the last moment of the completion of the intake stroke relative to a comparative reference value as described above, it becomes possible to inject fuel whose amount is responsive to an air amount which is actually sucked during the intake stroke. Therefore, even when the intake air amount is changed due to the continuous changes in the opening degree of the throttle valve during the intake stroke, it becomes possible to prevent the excess and deficiency of fuel by injecting fuel whose amount is responsive to the actual intake air amount.

The above described load detecting parameter may be a parameter which varies depending on the load condition of the internal combustion engine, and it is preferable that an intake pipe pressure of the internal combustion engine is used as this parameter, for example. In this case, an intake pressure map which provides a relation among the opening degree of the throttle valve, the rotational speed, and the intake pipe pressure of the internal combustion engine is used as a parameter map for detecting the load.

Further, an intake pipe pressure has a minimum value during the intake stroke as in the case of a four-cycle single cylinder internal combustion engine and a multi-cylinder internal combustion engine which has an intake pipe mounted on each cylinder, it is preferable that the minimum value is used as the intake pipe pressure.

Further, the basic injection time of fuel may also be used as the parameter for detecting the load, and the output torque at a time of the steady operation of the engine may also be used as the above described parameter for detecting the load.

When the basic injection time of fuel is used as the parameter for detecting the load, a basic injection time map based on the throttle valve opening degree and speed which provides a relation among the opening degree of the throttle valve, the rotational speed, and the basic injection time is used as the parameter map for detecting the load.

When the output torque of the internal combustion engine is used as the parameter for detecting the load, a torque map which provides a relation among the opening degree of the throttle valve, the rotational speed, and the output torque of the internal combustion engine is used as the parameter map for detecting the load.

The above described correction variable arithmetical operation means is preferably comprised such that the arithmetical operation of the correction variable is performed only when the opening degree of the throttle valve exceeds a predetermined correction permitting throttle opening degree.

According to the construction as described above, it becomes possible to prevent a hunting phenomenon in which an operation for increasing the fuel injection quantity and an operation for decreasing the fuel injection quantity are repeatedly performed.

Also, the above described correction variable arithmetical operation means is preferably comprised such that the arithmetical operation of the correction variable is performed only when a magnitude of the map retrieval value variation exceeds a set value and the rotational speed is less than an increment permitting rotational speed after it is determined from a sign of the map retrieval value variation that the load of the internal combustion engine is changed to be increased, while the arithmetical operation of the correction variable is performed only when a magnitude of the map retrieval value variation exceeds the set value and the rotational speed is not less than an decrement permitting rotational speed after it is determined from a sign of the map retrieval value variation that the load of the internal combustion engine is changed to be decreased.

Further, the above described correction arithmetical operation means is preferably comprised such that the arithmetical operation of the correction variable is performed only when a magnitude of the map retrieval value variation exceeds the set value, the rotational speed is less than the increment permitting rotational speed, and the opening degree of the throttle valve is not less than a predetermined increment permitting opening degree of the throttle valve after it is determined from a sign of the map retrieval value variation that the load of the internal combustion engine is changed to be increased, while the arithmetical operation of the correction variable is performed only when a magnitude of the map retrieval value variation exceeds the set value, the rotational speed is not less than the decrement permitting rotational speed, and the opening degree of the throttle valve is not less than a predetermined decrement permitting opening degree of the throttle valve after it is determined from a sign of the map retrieval value variation that the load of the internal combustion engine is changed to be decreased.

BRIEF DESCRIPTION OF THE DRAWINGS

The above and other objects and features of the invention will be apparent from the detailed description of the preferred embodiment of the invention, which is described and illustrated with reference to the accompanying drawings, in which;

FIGS. 9A to 9D are timing diagrams for illustrating operations of the fuel injection control apparatus according to the present invention at a time of decelerating the engine;

FIGS. 10A to 10C are timing diagrams for illustrating operations when an asynchronous injection is performed by the fuel injection control apparatus according to the present invention;

FIGS. 11A to 11C are timing diagrams for illustrating operations when an additional injection is performed by the fuel injection control apparatus according to the present invention;

FIGS. 13A to 13C are diagrams showing examples of temporal responses of an intake pipe pressure and an opening degree of the throttle valve at a time of decelerating the four-cycle internal combustion engine and an example of a fuel injection command provided to the injector drive circuit.

DETAILED DESCRIPTION OF PREFERRED EMBODIMENTS

Embodiments of the present invention will be described below with reference to FIGS. 1 to 11.

Figure 1:
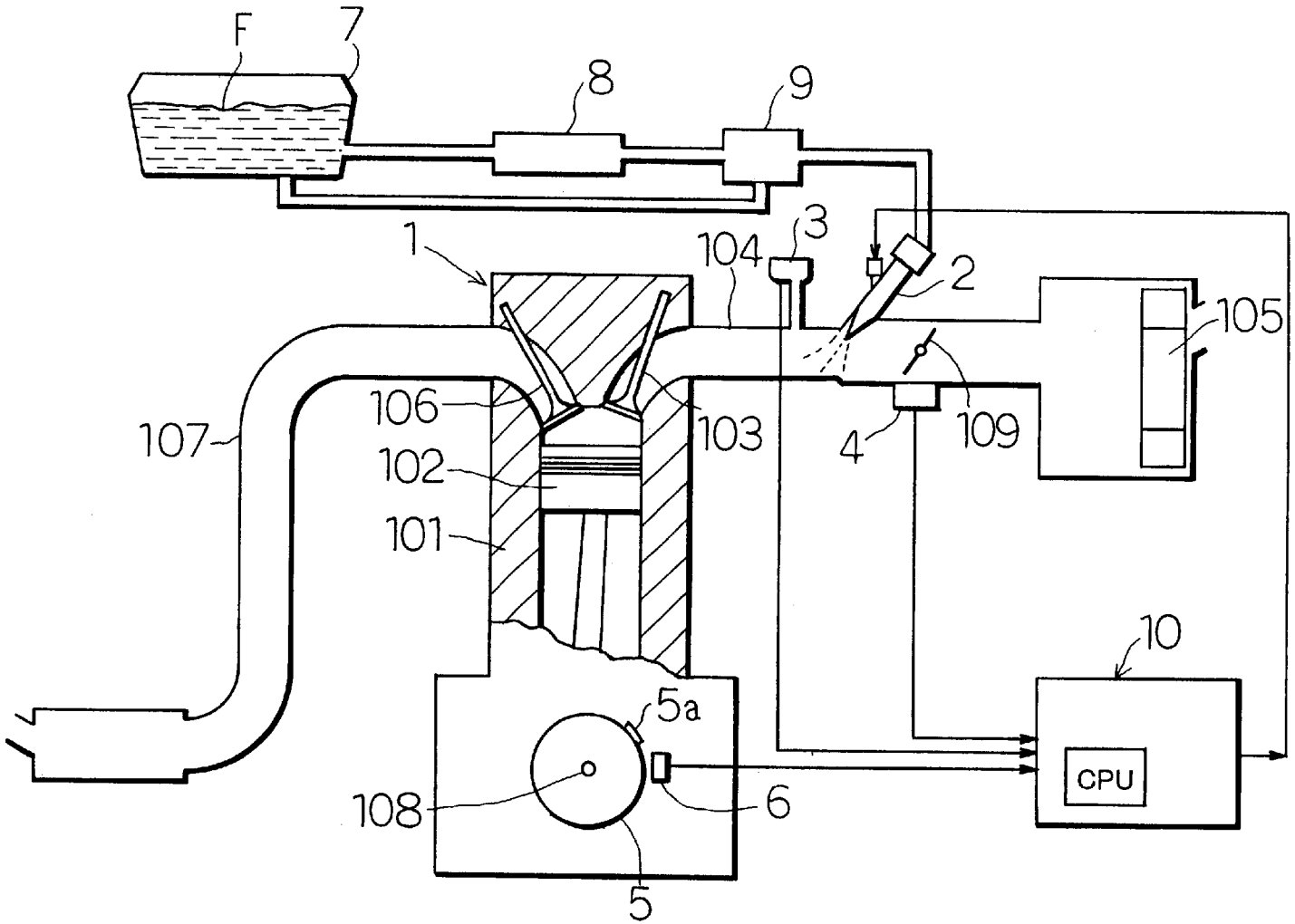
FIG. 1 is a block diagram showing a construction of hardware of a fuel injection control apparatus according to the present invention, together with an internal combustion engine.

FIG. 1 schematically shows an example of a construction of an internal combustion engine, which employs an electronic fuel injection control apparatus to which the present invention is applied, and its associated equipment. In this figure, reference numeral 1 denotes a four-cycle single cylinder internal combustion engine having a cylinder 101, a piston 102, an intake valve 103, an intake pipe 104, an air filter 105, an exhaust valve 106, an exhaust pipe 107, a crankshaft 108 and the like. The intake pipe 104 is fitted with a throttle valve 109 and also fitted with an injector 2 such that fuel is injected into the intake pipe at a downstream of the throttle valve 109. The intake pipe is also fitted with an intake pressure sensor 3 for detecting an intake pipe pressure at the downstream of the throttle valve 109 and a throttle sensor 4 for detecting an opening degree of the throttle valve 109.

Figures 8A, 8B, 8C, 8D, 8E:
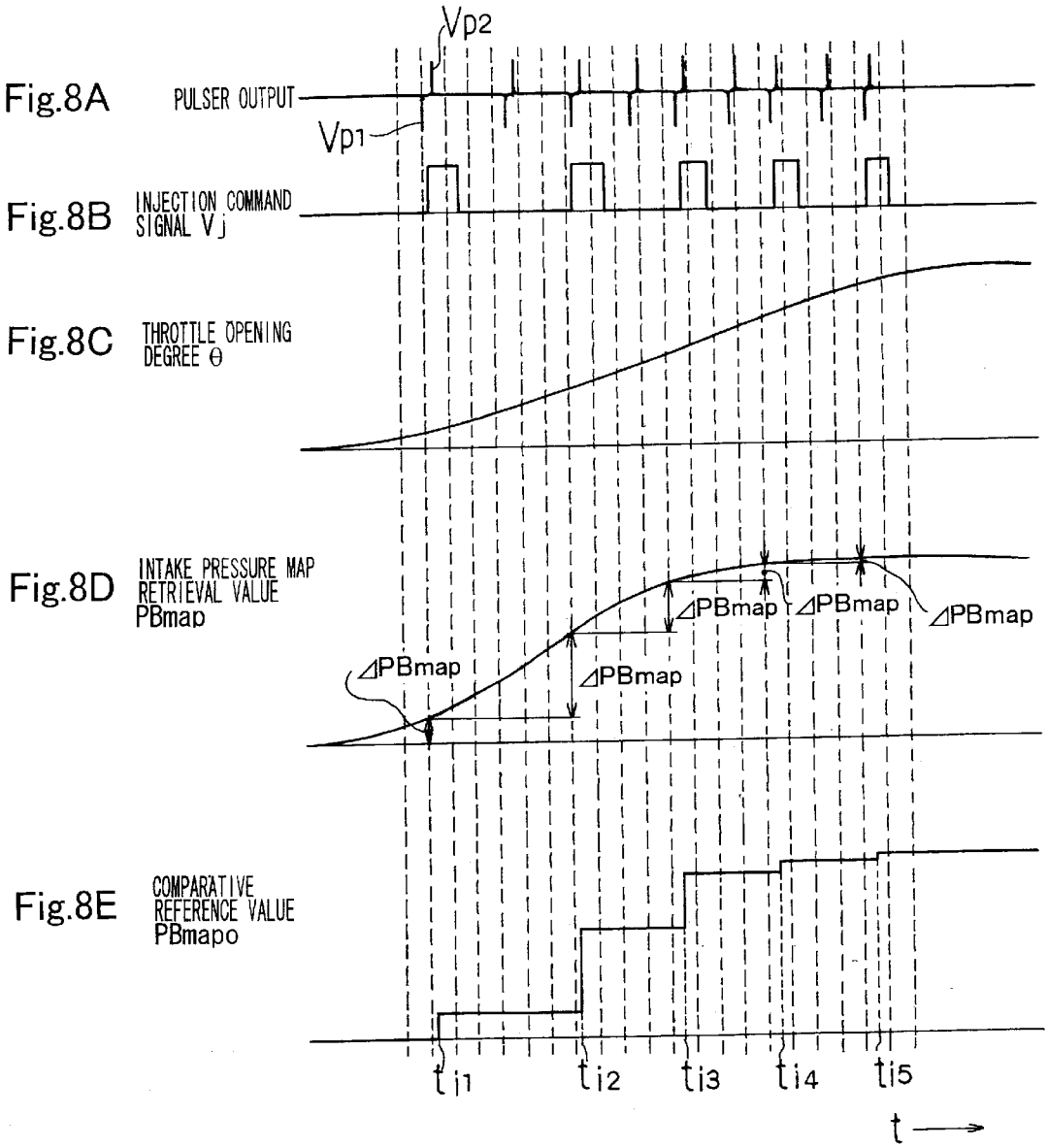
FIGS. 8A to 8E are timing diagrams for illustrating operations of the fuel injection control apparatus according to the present invention at a time of accelerating the engine.
Figures 12A, 12B, 12C:
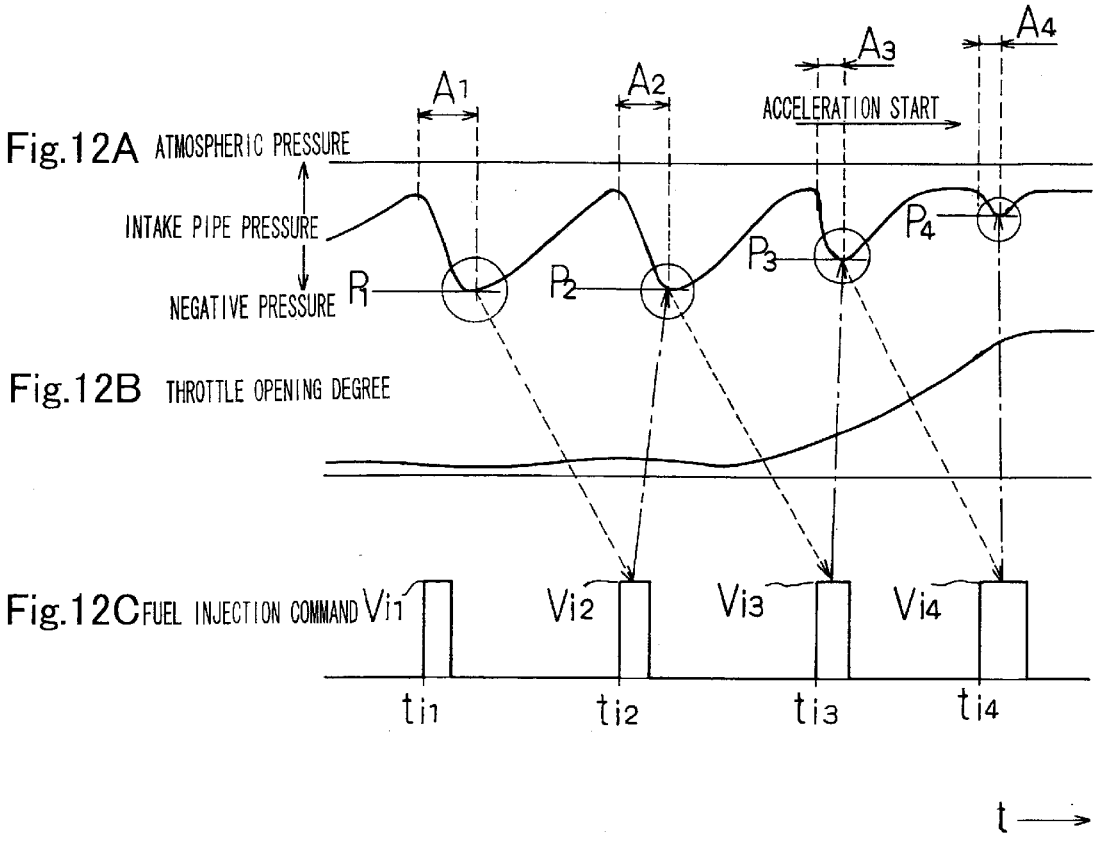
FIGS. 12A to 12C are diagrams showing examples of temporal responses of an intake pipe pressure and an opening degree of a throttle valve of a four-cycle internal combustion engine and an example of a fuel injection command provided to an injector drive circuit.

The crankshaft 108 of the engine is fitted with a flywheel 5, and a reluctor (an inductor) 5*a* which is a protrusion having a circular curve is formed on an outer periphery of the flywheel. A pulser 6 which is fixed to a housing of the engine or the like is placed at a lateral side of the periphery of the flywheel 5. The pulser 6 is a well known device which comprises an iron core having a magnetic pole portion facing to the reluctor 5*a*, a pulser coil wound around this iron core, and a permanent magnet magnetically coupled to the iron core. As shown in FIG. 8A for example, when an edge of a front end of the reluctor 5*a* in its rotational direction is detected and when an edge of a back end of the reluctor 5*a* in its rotational direction is detected, a reference pulse Vp1 and a detection pulse of an ignition position at a low speed Vp2 whose polarities are different are generated.

A generation position of the reference pulse is set to be matched with a reference crank angle position (a reference position) which has been set at a position advanced from a crank angle position where a piston of the engine reaches an upper dead point, and a generation position of the detection pulse of the ignition position at the low speed is set to be matched with a position which is suitable as an ignition position at a starting time and at a low speed of the engine (a position slightly advanced from the crank angle position where the piston of the engine reaches the upper dead point). An output from the pulser 6 is input through a waveform shaping circuit (not shown) into a CPU of an electronic control unit (ECU) 10 which will be described below and then used for obtaining information on rotation of the engine (such as information on the crank angle position being matched with a predetermined position and the rotational speed of the engine) when the fuel injection or the ignition timing of the engine for example are controlled.

The reference pulse Vp1 generated from the pulser 6 is used as a signal for detecting a timing of fuel synchronous injection performed at a constant crank angle position during each combustion cycle, and in addition, this reference pulse Vp1 is also used as a signal for detecting a position where measurement of the ignition timing of the internal combustion engine arithmetically operated by the CPU starts when the ignition timing of the internal combustion engine is controlled. On the other hand, the detection pulse of an ignition position at a low speed Vp2 is used as a signal for defining an ignition timing at a starting time and at a low speed of the engine where a rotational speed of the engine can not be detected precisely by a microcomputer which controls the ignition timing because a rotational speed of the crankshaft largely varies with the change of a stroke. That is, when the engine starts and is driven at a low speed, ignition operation is performed at a time of generating the pulse Vp2.

Reference numeral 7 denotes a fuel tank containing fuel F, and the fuel within the fuel tank 7 is supplied through a fuel pump 8 and a pressure regulator 9 to a fuel supply port of the injector 2. The pressure regulator 9 maintains a pressure of the fuel supplied to the injector 2 constant by returning a portion of the fuel to the fuel tank 7 when a pressure of the fuel fed by the fuel pump 8 exceeds a set value.

Reference numeral 10 denotes an electronic control unit (ECU) provided with a CPU, which controls injection of the fuel from the injector 2 and controls the ignition timing. Outputs from the intake pressure sensor 3, the throttle sensor 4, and the pulser 6 are input into this electronic control unit 10. Actually, outputs from the respective sensors which detect an atmospheric pressure, an intake temperature of the engine, and a cooling water temperature of the engine, for example, used as control conditions at a time of controlling the fuel injection are input into the ECU 10, but these sensors are not shown in this figure.

In the fuel injection control apparatus disclosed in this specification, a parameter whose value changes depending on a load applied to the internal combustion engine is defined as a parameter for detecting the load, a change in the load detecting parameter according to changes in the throttle valve opening degree and the rotational speed at a time of steady operation of the engine is predetermined by actual measurement, and a map which provides a relation among the throttle valve opening degree, the rotational speed, and the load detecting parameter of the engine is created as a parameter map for detecting the load, then the map is stored in the ROM or EEPROM in the microcomputer.

When the parameter map for detecting the load is created, for example, the engine is allowed to be rotated at various speeds by adjusting the load on the engine under the condition that an opening degree of the throttle valve of the engine is fixed to a certain value, then a value of the parameter for detecting the load is measured when the engine comes into a state where the engine rotates stably at each rotational speed (when the engine comes into its steady operational status). In this manner, the load detecting parameter values in a steady operational status when driving the engine at various rotational speeds are collected while maintaining the throttle valve opening degree constant. Repeating such measurements except that a value of the throttle valve opening degree changes at every measurement, load detecting parameter values at the steady operational status are measured relative to various combinations of throttle valve opening degrees and the rotational speeds. Thus collected data including throttle valve opening degrees, the rotational speeds and the load detecting parameters are used for creating a three-dimensional map which provides a relation among the throttle valve opening degree, the rotational speed, and the load detecting parameter.

In the electronic fuel injection control apparatus according to the present invention, a retrieval value on the above described map is arithmetically operated based on the throttle valve opening degree and the rotational speeds, and whether the loaded condition of the engine changes or not is determined from a variation of the map retrieval value. Then an actual injection time is determined by correcting a basic injection time of the fuel depending on the determination result and the fuel is injected from the injector during the actual injection time.

Figure 2:
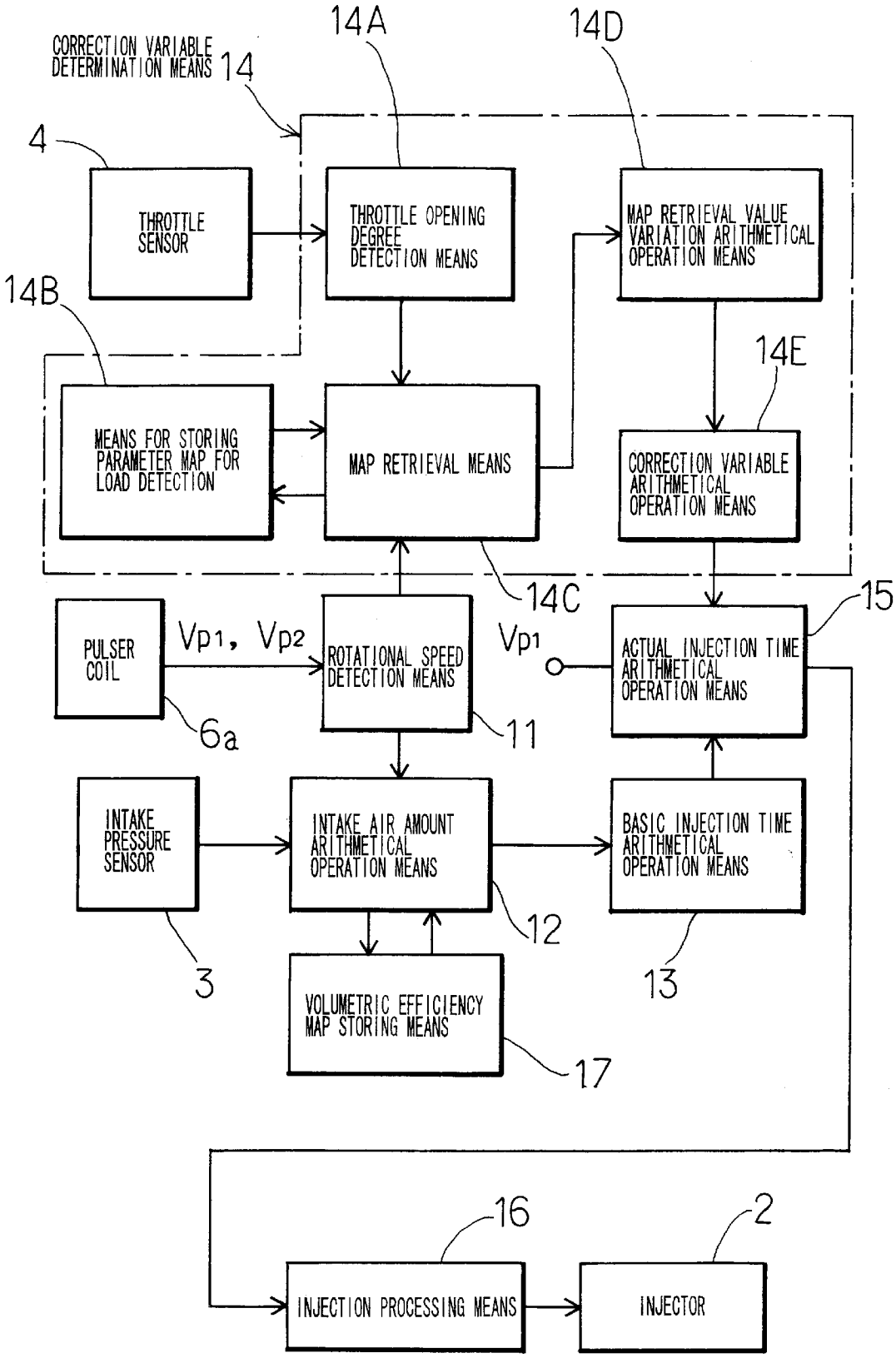
FIG. 2 is a block diagram showing a construction of an embodiment of the present invention.

A basic construction of the fuel injection control apparatus according to the present invention can be represented as shown in FIG. 2 for example.

As shown in FIG. 2, the fuel injection control apparatus according to the present invention comprises: intake air amount arithmetical operation means 12 for.arithmetically operating an intake air.amount based on a minimum value of an intake pipe pressure which is determined from a detection output of the intake pressure sensor 3 and a rotational speed of the engine which is detected from rotational speed detection means 11; basic injection time arithmetical operation means 13 for arithmetically operating a basic injection time of the fuel based on the intake air amount which is arithmetically operated by the intake air amount arithmetical operation means 12; correction.variable determination means 14 for determining a correction valuable by which the basic injection time arithmetically operated by the basic injection time arithmetical operation means 13 is multiplied; actual injection time arithmetical operation means 15 for performing an actual injection time arithmetical operation processing in which the basic injection time arithmetically operated by the basic injection time arithmetical operation means 13 is multiplied by the correction variable determined by the correction variable determination means 14 in order to arithmetically operate an actual injection time; and injection processing means 16 for performing a processing for injecting the fuel form the injector 2 during the arithmetically operated actual injection time.

In this example, the actual injection time arithmetical operation means 15 and the injection processing means 16 comprise synchronous injection control means for performing the actual injection time arithmetical operation processing which is for arithmetically operating the actual injection time by performing the correction arithmetical operation using the correction variable arithmetically operated by the correction variable arithmetical operation means at every time a predetermined synchronous injection timing is detected, and a processing which is for allowing the synchronous injection by actuating the injector during the arithmetically operated actual injection time.

The rotational speed detection means 11 can be comprised as appropriate, but in the example as shown in FIG. 2, the rotational speed is detected by arithmetically operating the rotational speed from an interval between the generated pulse signals (a time period required for rotating the crankshaft by a predetermined angle) which are output from the pulser coil 6*a* provided for the pulser 6 as shown FIG. 1.

The pulser coil in FIG. 1 is illustrated only by way of example of means for obtaining the information on rotation of the engine, so that the present invention is not limited to such an example where the information on rotation of the engine is obtained from the pulser.

The intake air amount arithmetical operation means 12 arithmetically operates an air amount (an intake air amount) which is sucked into a cylinder during an intake stroke based on the minimum value of the intake pipe pressure detected by the intake pressure sensor 3 and the rotational speed of the engine. In order to perform this arithmetical operation, in the example shown in FIG. 2, volumetric efficiency map storing means 17 which stores a volumetric efficiency map which provides a relation among the minimum value of the intake pipe pressure, the rotational speed, and the volumetric efficiency of the engine is provided, and then the intake air amount is arithmetically operated based on a retrieval value on the volumetric efficiency map which is searched for the minimum value of the intake pipe pressure and the rotational speed.

The basic injection time arithmetical operation means 13 arithmetically operates, as the basic injection time, a fuel injection time required for obtaining a gaseous mixture having a predetermined air-fuel ratio based on the intake air amount arithmetically operated by the intake air amount arithmetical operation means 12 and respective control conditions detected by sensors such as an atmospheric sensor or an intake temperature sensor which are not shown in this figure. This arithmetical operation for the basic injection time is usually performed by a map arithmetical operation.

The above described intake air amount arithmetical operation means 12, basic injection time arithmetical operation means 13, correction variable determination means 14, and actual injection time arithmetical operation means 15 are achieved by executing a predetermined program by the microcomputer provided to the ECU 10.

In the present invention, for estimating the loaded condition of the internal combustion engine, a parameter which varies depending on a change in the load on the engine is used as a parameter for detecting the load, and a parameter map for detecting the load which provides a relation among the throttle valve opening degree, the rotational speed, and the load detecting parameter is created considering the steady operation of the engine. Then, a retrieval value on the parameter map for detecting the load is arithmetically operated based on the rotational speed and the throttle valve opening degree at least at a synchronous injection timing or at the immediately preceding timing, and the change in the load on the engine is estimated from a variation of the map retrieval value which is produced within a time period from a previous synchronous injection timing or the immediately preceding timing to the present synchronous injection timing or the immediately preceding timing. From this change in the loaded condition, determination of whether the correction of the fuel injection quantity is required is performed. And if the correction is required, a correction variable used for the correction arithmetical operation where the basic injection time is corrected to determine the actual injection time is arithmetically operated. This correction variable is used for arithmetically operating the basic injection time in order to determine the actual injection time, then fuel is injected from the injector during this actual injection time.

Thus, in the example shown in FIG. 2, correction variable determination means 14 comprises: throttle valve opening degree detection means 14A for detecting a throttle valve opening degree from an output from the throttle sensor 4; load detecting parameter map storing means 14B for storing a load detecting parameter map which provides a relation among a load detecting parameter whose value varies depending on a change in the load on the internal combustion engine, the throttle valve opening degree of the internal combustion engine, and the rotational speed of the internal combustion engine; map retrieval means 14C for searching the load detecting parameter map for the throttle valve opening degree of the internal combustion engine and the rotational speed of the internal combustion engine and then arithmetically operating a retrieval value of the load detecting parameter as a map retrieval value PBmap; map retrieval value variation arithmetical operation means 14D in which a map retrieval value obtained by the map retrieval means at a previous synchronous injection timing or the immediately preceding timing is used as a comparative reference value and a difference between a map retrieval value, newly obtained by the map retrieval means at the present synchronous injection timing or the immediately preceding timing, and the comparative reference value is arithmetically operated as a map retrieval value variation; and correction variable arithmetical operation means 14E for arithmetically operating a correction valuable relative to the map retrieval value variation arithmetically operated by the map retrieval value variation arithmetical operation means 14D.

The map retrieval means 14C is comprised such that an arithmetical operation of the map retrieval value is performed at least at the synchronous injection timing or the immediately preceding timing, and the map retrieval value variation arithmetical operation means 14D is comprised such that an arithmetical operation of the map retrieval value variation is performed at every time the map retrieval means arithmetically operates the map retrieval value.

The correction variable arithmetical operation means 14E is comprised such that a correction valuable is arithmetically operated relative to the map retrieval value variation when the map retrieval value variation arithmetically operated at the synchronous injection timing or the immediately preceding timing exceeds a set value.

The actual injection time arithmetical operation means 15 is comprised such that the synchronous injection timing is detected when the pulser coil 6*a* recognizes the generation of the reference pulse signal Vp1 and then an actual injection time is arithmetically operated using the correction variable arithmetically operated by the correction variable arithmetical operation means 14E at the synchronous injection timing or the immediately preceding timing.

If the map retrieval means 14C repeatedly performs the arithmetical operation of the map retrieval values at very close time intervals, the correction variable is arithmetically operated by using a variation of the map retrieval value relative to the comparative reference value, the map retrieval value being arithmetically operated immediately before the synchronous injection timing by the map retrieval means.

If the map retrieval means 14C is comprised such that the map retrieval value is arithmetically operated when the synchronous injection timing is detected, the correction variable is arithmetically operated by using a variation of the map retrieval value relative to the comparative reference value, the map retrieval value being arithmetically operated at the synchronous injection timing.

The injection processing means 16 provides an injection command signal to an injector drive circuit during an injection time which is arithmetically operated by the actual injection time arithmetical operation means 15 and then injects fuel from the injector.

Among the load detecting parameters of the engine which allow for the measurements or the operations, a parameter whose value varies depending on a change in the load on the engine may be used for the present invention. However, a minimum value of the intake pipe pressure of the internal combustion engine is used as the load detecting parameter in this embodiment. Therefore, as the load detecting parameter map, an intake pressure map which provides a relation among the rotational speed of the engine, the throttle valve opening degree, and an intake pipe pressure during an intake stroke (the minimum value when the intake pipe pressure has a minimum value during the intake stroke) is used.

In this embodiment, the map retrieval means 14C and the map retrieval value variation arithmetical operation means 14D respectively perform an arithmetical operation of the map retrieval value and an arithmetical operation of the map retrieval value variation repeatedly at very close time intervals $\Delta t$ (2 msec. in this case), and a correction variable is arithmetically operated at every time the map retrieval value variation is obtained. In this example, a correction amount which is added to or subtracted from the basic injection time is used as the correction variable.

FIGS. 8A to 8E are timing diagrams showing operations of the fuel injection control apparatus according to the present invention, among which FIG. 8A shows pulse signals being output from the pulser coil 6*a* and FIG. 8B shows synchronous injection command signals Vj provided to a drive circuit for actuating the injector 2.

The pulser coil generates a reference pulse Vp1 at a reference position which is set at a position being substantially advanced from the crank angle position corresponding to an upper dead point of a piston of the engine, and also generates a detection pulse of an ignition position at a low speed Vp2 at a position slightly advanced from the crank angle position corresponding to the upper dead point. The reference signal Vp1 generated immediately before starting an intake stroke is used as a signal for detecting the synchronous injection timing.

The injection command signal Vj is a pulse signal which maintains a time H level corresponding to an injection time, and the injector 2 injects fuel by opening its valve during a time period in which the injection command signal Vj is at the H level.

FIG. 8C shows throttle valve opening degrees θ, and FIG. 8D shows retrieval values PBmap on the intake pressure map. Further, FIG. 8E shows comparative reference values PBmap0 compared with the map retrieval values.

Broken lines in FIG. 8 show timings for performing the retrieval of the intake pressure map, the arithmetical operation of the map retrieval value, and the arithmetical operation of the correction variable, and each timing appears at 2-msec. intervals.

In addition, ti1 to ti5 show a series of synchronous injection timings, and these synchronous injection timings are coincident with timings at which the pulser coil 6*a* generates reference pulses Vp1 immediately before starting the intake stroke.

In the example shown in FIG. 8, an operation for increasing the throttle valve opening degree θ is performed in order to accelerate the engine, then the throttle valve opening degree θ is maintained constant. As the throttle valve opening degree θ will change as described above, a map retrieval value PBmap to be obtained will be changed like a curve in FIG. 8D, for example.

FIGS. 9A to 9D show examples of the synchronous injection command signal Vj, the throttle valve opening degree θ, the retrieval value PBmap on the intake pressure map, and the comparative reference value PBmap0 respectively, all of which being changed with time t when an operation for closing the throttle valve is closed for decelerating the engine. In these examples, each of times ti1, ti2, ti3, and ti4 is a timing for starting the synchronous injection processing, and the synchronous injection command signal Vj is provided to the injector immediately after detecting these synchronous injection timings. In the vicinity of the timing ti1, an operation of closing the throttle valve in order to decelerate the engine starts and the throttle valve opening degree θ is decreased as shown in FIG. 9B. As the throttle valve opening degree θ will change, the retrieval value PBmap on the intake pressure map will change as shown in FIG. 9C.

As apparent from FIGS. 8C, 8D, and FIGS. 9B, 9C, the map retrieval value (a minimum value of the intake pipe pressure, in this example) PBmap increases as the throttle valve opening degree θ increases, while the map retrieval value PBmap decreases as the throttle valve opening degree θ decreases.

Although not shown in the figures, even if the throttle valve opening degree θ is constant, the map retrieval value PBmap increases when the load on the engine increases due to a climbing run of the engine or the like, while the map retrieval value PBmap decreases when the load decreases.

That is, the retrieval value PBmap on the load detecting parameter map (an intake pressure map, in this example) increases when the load on the engine increases, while the above described retrieval value PBmap decreases when the load on the engine decreases. Therefore, it is possible to determine whether the load on the engine changes to be increased or decreased by observing a changing direction of the map retrieval value PBmap, and it becomes possible to know a degree of changes of the loaded condition of the engine from a variation of the map retrieval value PBmap.

In the present invention, at every time the retrieval value PBmap on the intake pressure map is arithmetically operated, a map retrieval value obtained at the previous synchronous injection timing or the immediately preceding timing is used as a comparative reference value PBmap0 and then the comparative reference value PBmap0 is subtracted from a newly obtained map retrieval value PBmap to determine a map retrieval value variation ΔPBmap. As shown in FIGS. 8E and 9D, the comparative reference value PBmap0 is maintained constant from each synchronous injection timing to the next synchronous injection timing.

As described above, if the map retrieval value variation ΔPBmap is arithmetically operated by subtracting the comparative reference value from the newly obtained map retrieval value, the map retrieval value variation ΔPBmap has a positive sign when the load on the engine changes to be increased, as in the case of performing an accelerating operation of the engine. On the other hand, the map retrieval value variation ΔPBmap has a negative sign when the load on the engine changes to be decreased as in the case of performing an decelerating operation of the engine. Therefore, it becomes possible to know whether the load on the engine changes to be increased or decreased by observing a sign of the map retrieval value variation ΔPBmap.

A magnitude (an absolute value) of the above described map retrieval value variation ΔPBmap corresponds to a variation of the load on the engine produced during a time period from the previous synchronous injection timing (or the immediately preceding timing) to the present synchronous injection timing (or the immediately preceding timing). Therefore, from the magnitude of the map retrieval value variation ΔPBmap, it becomes possible to know changes of the loaded condition of the engine produced during a time period from the previous synchronous injection timing (or the immediately preceding timing) to the present synchronous injection timing (or the immediately preceding timing), and consequently, the correction variable for the injection timing can be determined.

In the present invention, whether the load on the engine changes to be increased or decreased is determined from a sign of the above described map retrieval value variation ΔPBmap which has been arithmetically operated at each synchronous injection timing or at the immediately preceding timing, and a correction variable for increasing or decreasing a fuel quantity is arithmetically operated when a magnitude of the map retrieval value variation ΔPBmap exceeds a set value. Then, this correction variable is used for performing the correction arithmetical operation on the basic injection time to arithmetically operate an actual injection time, and fuel is injected during the actual injection time immediately after arithmetically operating the actual injection time.

For example, when a map retrieval value is arithmetically operated at the synchronous injection timing ti2 or the immediately preceding timing as shown in FIG. 8, the map retrieval value variation arithmetical operation means 14D arithmetically operates a map retrieval value variation ΔPBmap by using a map retrieval value obtained by the map retrieval means 14C at the previous synchronous injection timing ti1 or the immediately preceding timing as a comparative reference value PBmap0 and then subtracting the comparative reference value PBmap0 from a map retrieval value PBmap obtained at the present synchronous injection timing ti2 or the immediately preceding timing. The correction variable arithmetical operation means 14E detects that the engine is being accelerated (a load on the engine changes to be increased) by observing a positive sign of this map retrieval value variation ΔPBmap and arithmetically operates a correction amount Tacc which is to be added to the basic injection time in order to increase the fuel quantity when a magnitude of this map retrieval value variation ΔPBmap exceeds the set value. The actual injection time arithmetical operation means 15 determines an actual injection time which is extended longer than the basic injection time by adding the correction amount Tacc to the basic injection time when the synchronous injection timing is detected. Subsequently, the synchronous injection processing means 16 immediately provides an injection command signal Vj, whose signal width corresponds to this actual injection time, to the injector drive circuit in order to inject fuel from the injector 2.

For example, at the synchronous injection timing ti2 as shown in FIG. 9, the map retrieval value variation arithmetical operation means 14D arithmetically operates a map retrieval value variation ΔPBmap by using a map retrieval value obtained by the map retrieval means 14C at the previous synchronous injection timing ti1 or the immediately preceding timing as a comparative reference value PBmap0 and then subtracting the comparative reference value PBmap0 from a map retrieval value PBmap obtained at the present synchronous injection timing ti2 or the immediately preceding timing. The correction variable arithmetical operation means 14E detects that the engine is being decelerated (a load on the engine changes to be decreased) by observing a negative sign of the map retrieval value variation ΔPBmap and arithmetically operates a correction amount Tdcl as the correction variable which is to be subtracted from the basic injection time in order to decrease the fuel quantity when a magnitude of this map retrieval value variation ΔPBmap exceeds the set value. The actual injection time arithmetical operation means 15 determines an actual injection time which is reduced compared with the basic injection time by subtracting the correction amount Tdcl from the basic injection time when the synchronous injection timing is detected. Subsequently, an injection command signal Vj, whose signal width corresponds to this actual injection time, is immediately provided to the injector drive circuit in order to inject fuel from the injector 2.

In the present invention as described above, a correction variable which is commensurate with changes in the loaded conditions of the engine produced during a time period from the previous synchronous injection timing (or the immediately preceding timing) to the present synchronous injection timing (or the immediately preceding timing) is determined, and then fuel is immediately injected during the actual injection time which has been determined by correcting the basic injection time by using this correction variable. Therefore, it is possible to inject fuel whose amount is always commensurate with the changes in the loaded condition of the engine for keeping an air-fuel ratio of the gaseous mixture within a proper range, and it is also possible to prevent the air-fuel ratio from becoming leaner when the load on the engine changes to be increased as in the case of accelerating the engine or from becoming richer when the load on the engine changes to be decreased.

In the above described control, the correction variable used for arithmetically operating the synchronous injection time is determined based on the map retrieval value variation obtained at a timing immediately before the synchronous injection and is also determined provided that the loaded condition at the timing immediately before the synchronous injection continues as it is. However, if the throttle valve opening degree continuously increases even after the beginning of the synchronous injection as in the case of rapidly opening the throttle valve in order to sharply accelerate the engine, an air amount sucked until an intake stroke completes may increase compared with an intake air amount estimated immediately before starting the synchronous injection. In such a case, the fuel quantity becomes insufficient only by performing the synchronous injection and the air-fuel ratio becomes leaner.

In this case, in addition to the synchronous injection for performing the fuel injection at a predetermined timing, it is preferable that an asynchronous injection which is for injecting fuel at any time it is detected that the injection quantity is insufficient after performing the synchronous injection is performed. This asynchronous injection is performed when it is detected that the fuel injection quantity is insufficient within the intake stroke, immediately after performing the synchronous injection.

However, if the asynchronous injection timing delays and the fuel injected by the asynchronous injection is not sucked into a cylinder of the engine, an air-fuel ratio of the gaseous mixture which flows into the cylinder during the next intake stroke may become richer. Therefore, the asynchronous injection is required to be performed at a timing in which fuel injected by the asynchronous injection can be sucked in the cylinder of the engine.

Figure 3:
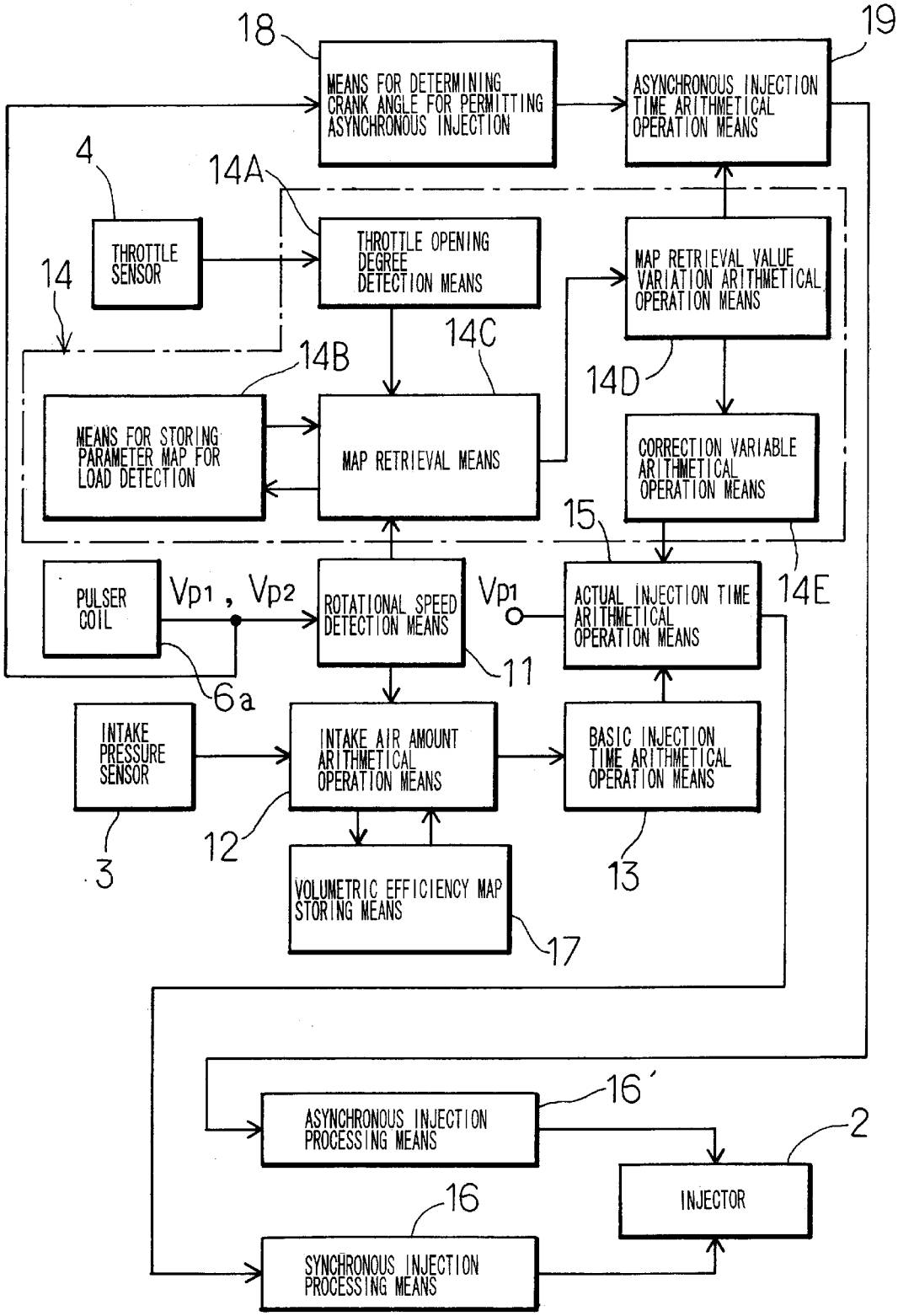
FIG. 3 is a block diagram showing a construction of another embodiment of the present invention.

If the synchronous injection and the asynchronous injection are performed, the electronic fuel injection control apparatus according to the present invention is further provided with asynchronous injection permitting crank angle determination means 18, asynchronous injection time arithmetical operation means 19, and asynchronous injection processing means 16' as shown in FIG. 3.

The asynchronous injection permitting crank angle determination means 18 is comprised such that it becomes possible to determine whether or not the present crank angle position of the internal combustion engine is at a crank angle position where the asynchronous injection is permitted, and the asynchronous injection time arithmetical operation means 19 is comprised such that the asynchronous injection time required for making up for a deficiency in fuel is arithmetically operated when it is detected that the fuel is insufficient after the synchronous injection. The asynchronous injection processing means 16' performs a processing for injecting the fuel from the injector during the arithmetically operated asynchronous injection time when the asynchronous injection time arithmetical operation means arithmetically operates the asynchronous injection time after completing the synchronous injection and when the asynchronous injection permitting means permits the asynchronous injection.

In this case, the map retrieval means 14C is comprised such that map retrieval values are arithmetically operated repeatedly at very close time intervals during a time period where the asynchronous injection is permitted at least after completing the synchronous injection, and on the other hand, map retrieval values are arithmetically operated at least at the synchronous injection timing or at the immediately preceding timing during the other time of periods.

The crank angle position which permits the asynchronous injection is a crank angle position within a range where a large portion of the fuel injected at the position can flow into the cylinder of the engine and is also at a position before reaching a crank angle position where the intake stroke is completed.

As for the fuel injected at the asynchronous injection, when a quantity of the fuel remaining within the intake pipe is increased, an air-fuel ratio during the next intake stroke may become richer. Thus, it is necessary to avoid performing the asynchronous injection at a crank angle position where a substantial amount of the injected fuel may not be sucked into the cylinder and may be remained within the intake pipe.

Determination whether or not a rotational angle position of the crankshaft is within a range of a crank angle permitting the asynchronous injection is performed by measuring a rotational angle position of the crankshaft relative to a position (a reference position) at which the pulser coil 6*a* generates a reference pulse signal Vp1 at the end of an exhaust stroke. For example, the determination can be performed as follows: an encoder, which generates a pulse signal at every time the crankshaft rotates by a very small angle, is provided; the output pulses from the encoder are counted from a position at which the pulser coil generates the reference pulse signal; a rotational angle position of the crankshaft relative to the reference position is detected; and whether or not the detected respective rotational angle positions are within a range where the asynchronous injection is permitted is determined. Also, the determination can be performed as follows: a timer, which starts a timing operation at a timing where the pulser coil generates the reference pulse signal, is provided; the rotational angle position relative to the reference position of the crankshaft is determined by the arithmetical operation based on the time measured by the timer and the rotational speed of the engine; and whether or not the determined rotational angle position is within a range of the crank angle permitting the asynchronous injection.

The asynchronous injection time arithmetical operation means 19 is comprised such that the asynchronous injection time is arithmetically operated when it is detected that the map retrieval value variation arithmetically operated at a very close time interval reaches a preset asynchronous determination value.

FIGS. 10A to 10C show examples of timing diagrams in the case where the asynchronous injection is performed after performing the synchronous injection. FIG. 10A shows pulse signals Vp1 and Vp2 which are output by the pulser coil, and FIG. 10B shows a map retrieval value PBmap. FIG. 10C shows a synchronous injection command signal Vj generated at the synchronous injection timing and an asynchronous injection command signal Vj' generated at the asynchronous injection timing.

In this example, after the synchronous injection command signal Vj is generated at the synchronous injection timing ti1, a map retrieval value obtained at a timing immediately before the synchronous injection timing ti1 is used as a new comparative reference value PBmap0 in order to determine a map retrieval value variation ΔPBmap at a very close time interval by subtracting the comparative reference value from a map retrieval value PBmap which is arithmetically operated at a very close interval. Subsequently, a timing where this map retrieval value variation ΔPBmap exceeds an asynchronous determination value β is used as an asynchronous injection timing ta, then at this asynchronous injection timing, the asynchronous injection command signal Vj' whose pulse width corresponds to the asynchronous injection time is allowed to be generated.

The asynchronous injection time is set at an appropriate value considering such as the throttle valve opening degree, the rotational speed of the engine, a time period from the synchronous injection timing ti1 to a timing where the map retrieval value variation reaches the asynchronous determination value β, and the number of performing the asynchronous injection. The arithmetical operation of this asynchronous injection time can be performed by the map arithmetical operation.

Performing the asynchronous injection at any time when the deficiency of fuel is detected after the synchronous injection as described above, the deficiency of fuel can be immediately made up by the asynchronous injection when the fuel becomes insufficient due to a continuous increase in the throttle valve opening degree during a time period where the injected fuel is sucked into a cylinder of the engine after performing the synchronous injection. Therefore, the air-fuel ratio is prevented from becoming leaner and the running performance of the engine can be improved.

Also in the electronic fuel injection control apparatus according to the invention, in order to prevent the excess and deficiency of fuel due to a change in the throttle valve opening degree or the load after performing the synchronous injection, an additional injection can be performed when the fuel is insufficient at an additional injection timing which is set at a timing immediately before completing an intake stroke after the synchronous injection (at the same timing every time).

Figure 4:
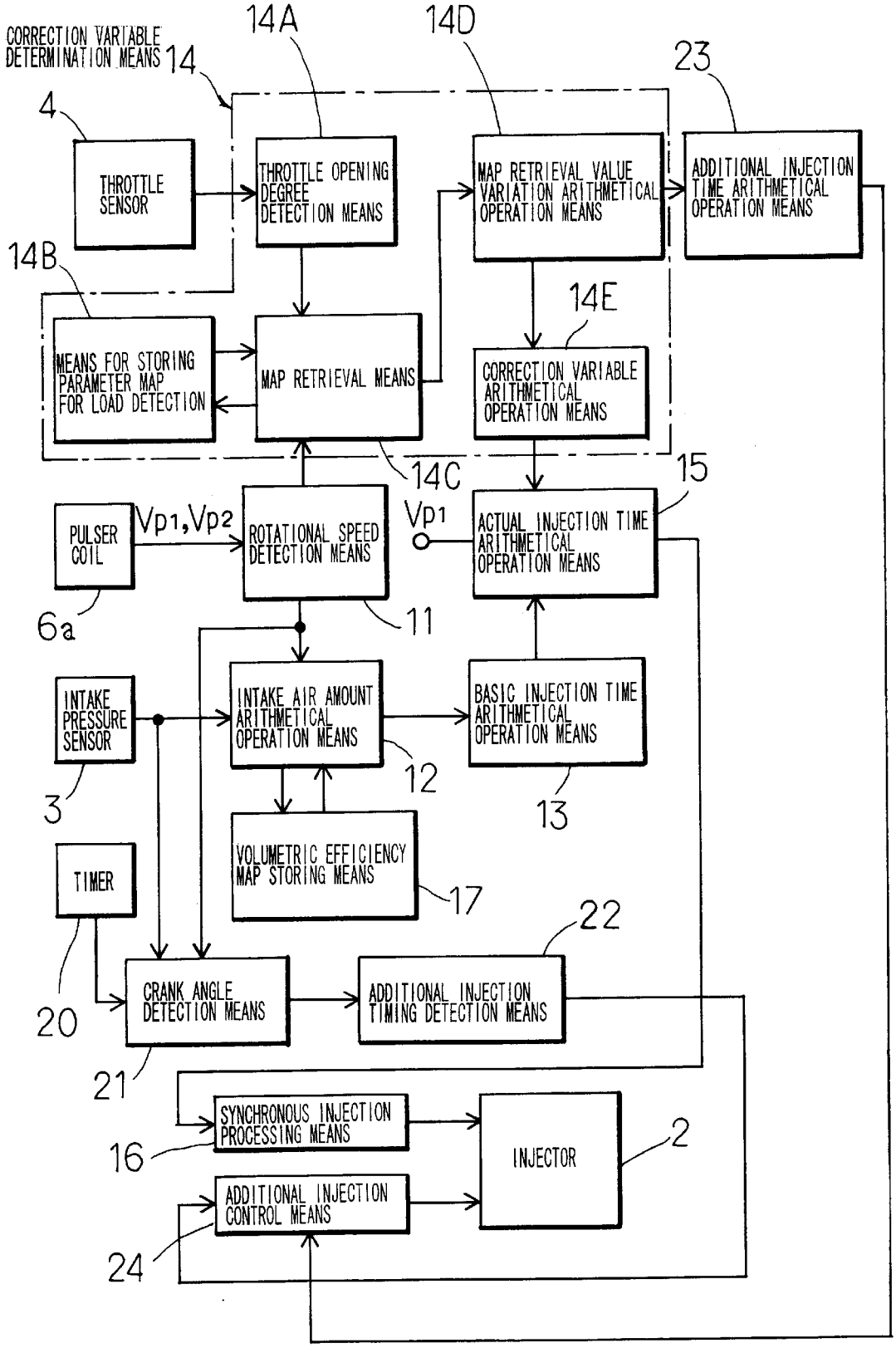
FIG. 4 is a block diagram showing a construction of still another embodiment of the present invention.

FIG. 4 shows a construction of a primary part of the electronic fuel injection control apparatus in the case where the synchronous injection and the additional injection are performed as described above. In addition to the construction shown in FIG. 2, this example further comprises: crank angle detection means 21 for detecting a crank angle position of the engine based on the output from the pulser coil 6*a*, the output from the timer 20, and the output from the rotational speed detection means 11; additional injection timing detection means 22 for detecting an additional injection timing which is set at the end of an intake stroke of the internal combustion engine (at a timing where the crank angle position of the engine matches with the additional injection position) based on the crank angle detected by the crank angle detection means 21; additional injection quantity arithmetical operation means 23 for arithmetically operating an additional injection time required for making up for the deficiency in fuel when it is detected that the fuel is insufficient from the map retrieval value variation arithmetically operated at the additional injection timing; and additional injection processing means 24 for performing an operation for injecting fuel from the injector 2 during the additional injection time which is arithmetically operated by the additional injection quantity arithmetical operation means 23.

In this case, the map retrieval means 14C and the map retrieval value variation arithmetical operation means 14D are comprised such that an arithmetical operation of the map retrieval value and an arithmetical operation of the map retrieval value variation are performed at least at the synchronous injection timing or the immediately preceding timing and the additional injection timing or the immediately preceding timing.

The crank angle detection means 21 starts the timer 20 at every time the pulsed coil 6*a* generates the reference pulse Vp1 and reads a time which is measured by the timer and a rotational speed which is detected by the rotational speed detection means 11, and then measures an angle between a rotational angle position at each moment and the reference position base on the output from the timer 20 (a lapse from a time when the reference pulse Vp1 is generated) and the rotational speed.

The additional injection timing detection means 22 detects that the additional injection timing is present when a crank angle detected by the crank angle detection means 21 becomes equals to an angle corresponding to the additional injection timing. That is, the additional injection timing is given by a crank angle from a position at which the reference pulse Vp1 is generated (the reference position). As described above, this additional injection timing is set to be a timing slightly before a timing where an intake valve of the internal combustion engine closes such that fuel injected at the additional injection timing can flow into a cylinder of the internal combustion engine.

If an encoder which generates pulses at every time the crankshaft rotates by a very small angle can be provided, the additional injection timing detection means 22 can also be comprised such that counting of the output pulses of the encoder is started when the pulser coil generates the reference pulse signal at the end of an exhaust stroke and then the additional timing is detected when the count of the output pulses of the encoder reaches a set value.

The additional injection time arithmetical operation means 23 determines whether or not the map retrieval value variation ΔPBmap arithmetically operated by the map retrieval value variation arithmetical operation means 14D exceeds a preset additional injection determination value A when the additional injection timing detection means 22 detects the additional injection timing, and then arithmetically operates an additional injection time Tadd when the map retrieval value variation ΔPBmap exceeds the additional injection determination value A.

The additional injection processing means 24 is comprised such that an additional injection command signal whose signal width corresponds to the arithmetically operated additional injection time Tadd is provided to the injector drive circuit in order to inject fuel from the injector 2.

This embodiment is comprised such that the above described additional injection control means 23 arithmetically operates the additional injection time Tadd for performing the additional injection only when the map retrieval value variation exceeds a set value and when the rotational speed is less than a set rotational speed and the throttle valve opening degree is not less than the additional injection determination value. The rest of the construction of the fuel injection control apparatus shown in FIG. 4 is the same as that shown in FIG. 2.

FIGS. 11A to 11C show timing diagrams in the case where the additional injection is performed after the synchronous injection. FIG. 11A shows injection command signals, and FIGS. 11B and 11C show a map retrieval value PBmap and a throttle valve opening degree θ, respectively. In FIG. 11, EXH, INT, COM and EXP represent an exhaust stroke, an intake stroke, a compression stroke, and an extension stroke of the engine, respectively.

In this example, an accelerating operation for opening the throttle valve starts at a timing t0, and as the throttle valve opening degree increases, the map retrieval value PBmap also increases. At the synchronous injection timing t1, a map retrieval value arithmetically operated at a timing immediately before the previous synchronous injection timing (not shown) is used as a comparative reference value PBmap0, and a map retrieval value variation ΔPBmap1 is arithmetically operated by subtracting the comparative reference value PBmap0 from a map retrieval value PBmap obtained at a timing immediately before the present synchronous injection timing t1. Consequently, an increment correction amount Tacc (a correction variable) for this map retrieval value variation ΔPBmap1 is arithmetically operated. The actual injection time arithmetical operation means 15 arithmetically operates an actual injection time Ti by adding this correction amount Tacc to the basic injection time. The synchronous injection processing means 16 generates a synchronous injection command signal Vj whose signal width corresponds to this actual injection time Ti and allows the injector 2 to inject fuel during the actual injection time. In the example shown in FIG. 11, a time width of a diagonally shaded portion of the synchronous injection command signal Vj corresponds the correction amount Tacc, while a time width of the other portion of the synchronous injection command signal Vj which is not diagonally shaded corresponds to the basic injection time Ti0.

In FIG. 11, t2 is an additional injection timing which is set slightly before a timing where the intake stroke is completed. The additional injection timing t2 is set such that this timing t2 is in the vicinity of a timing where the intake stroke completes as much as possible and almost all fuel injected at this timing t2 is sucked into a cylinder of the engine.

In the example shown in FIG. 11, the throttle valve opening degree continues to increase and the map retrieval value PBmap also continues to increase even after the synchronous injection. The additional injection timing detection means 22 generates an additional injection timing detection signal when it is detected that a crank angle position obtained by the crank angle detection means 21 is a crank angle position corresponding to the additional injection timing t2.

At this moment, the map retrieval value variation arithmetical operation means 14D arithmetically operates a map retrieval value variation ΔPBmap2 by using a map retrieval value PBmap arithmetically operated at a timing immediately before the synchronous injection timing t1 as a comparative reference value PBmap01.

The additional injection time arithmetical operation means 23 reads the map retrieval value variation ΔPBmap2 arithmetically operated by the map retrieval value variation arithmetical operation means 14D when the additional injection timing detection signals are provided at the additional injection timings t2. Then, an additional injection time Tadd is arithmetically operated when the map retrieval value variation ΔPBmap2 exceeds the additional injection determination value A and when a rotational speed is less than the set rotational speed and the throttle valve opening degree is not less than the additional injection determination value. An additional injection command signal Vja whose signal width corresponds to this additional injection time Tadd is provided to the injector drive circuit from the additional injection processing means 24, then the injector 2 is actuated.

In the example shown in FIG. 2, the throttle valve opening degree continues to increase and the map retrieval value PBmap also continues to increase even after the synchronous injection, so that the map retrieval value variation ΔPBmap2 exceeds the additional injection determination value A at the additional injection timing t2 and the additional injection command signal Vja is generated.

As described above, when the additional injection is performed, it is possible, just before completing the intake stroke, to make up the deficiency in fuel due to the continuous operation for opening the throttle valve from the start of the synchronous injection to the end of the intake stroke. Therefore, it becomes possible to prevent the air-fuel ratio from becoming leaner due to the deficiency in fuel when the engine is accelerated, for example.

In addition, when an injection quantity at the additional injection is determined by estimating a loaded condition of the engine based on a variation of a map value retrieved just before completing the intake stroke relative to the comparative reference value as described above, fuel whose amount being commensurate with the air amount actually sucked during the intake stroke can be injected. Therefore, it becomes possible to prevent the excess and deficiency of fuel by injecting fuel being commensurate with the actual intake air amount, even when the intake air amount is changing with an continuous increase in the throttle valve opening degree during the intake stroke.

Figure 5:
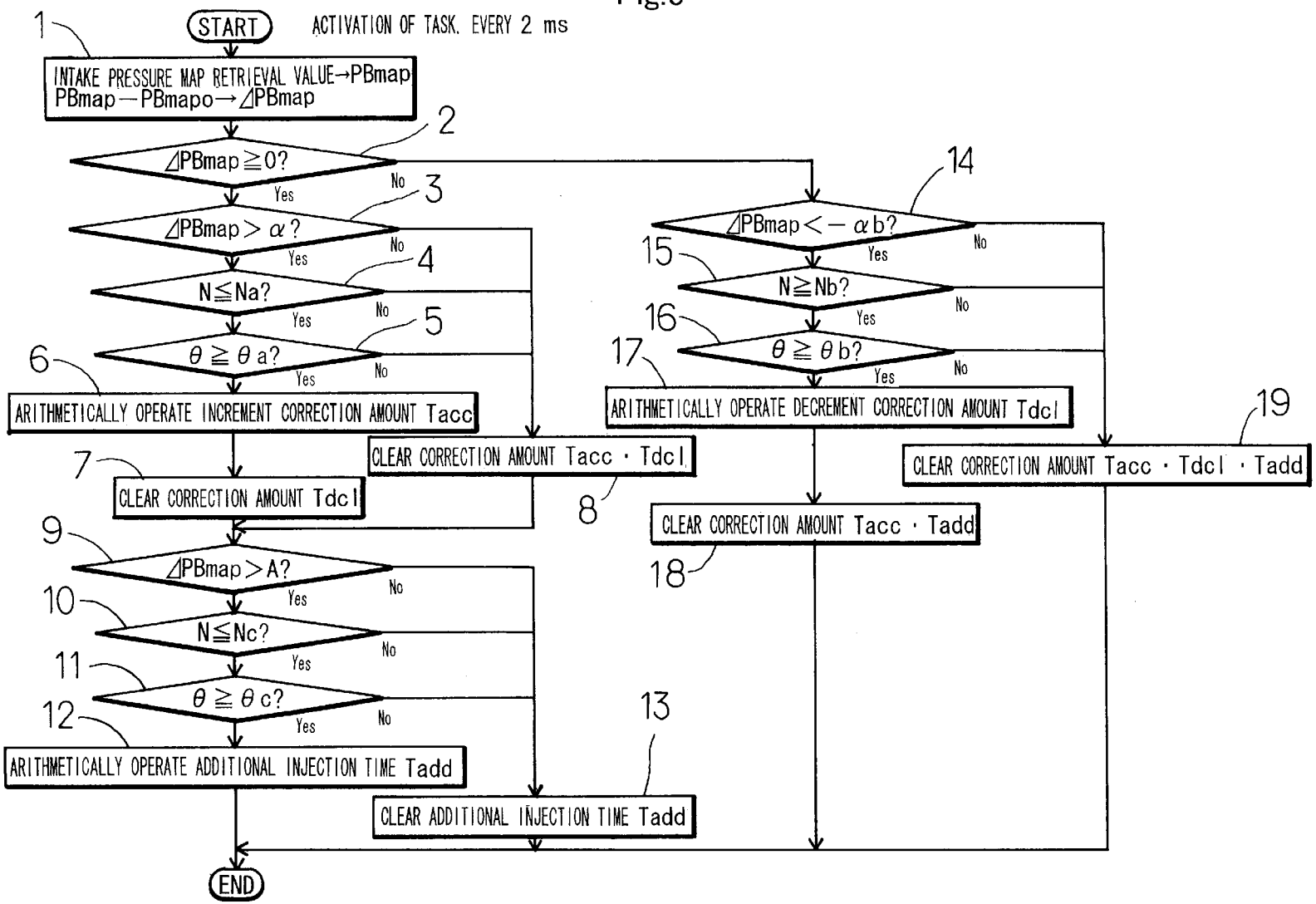
FIG. 5 is a flowchart showing an algorithm for a task which is carried out at regular time intervals by a microcomputer in an embodiment of the present invention.
Figure 6:
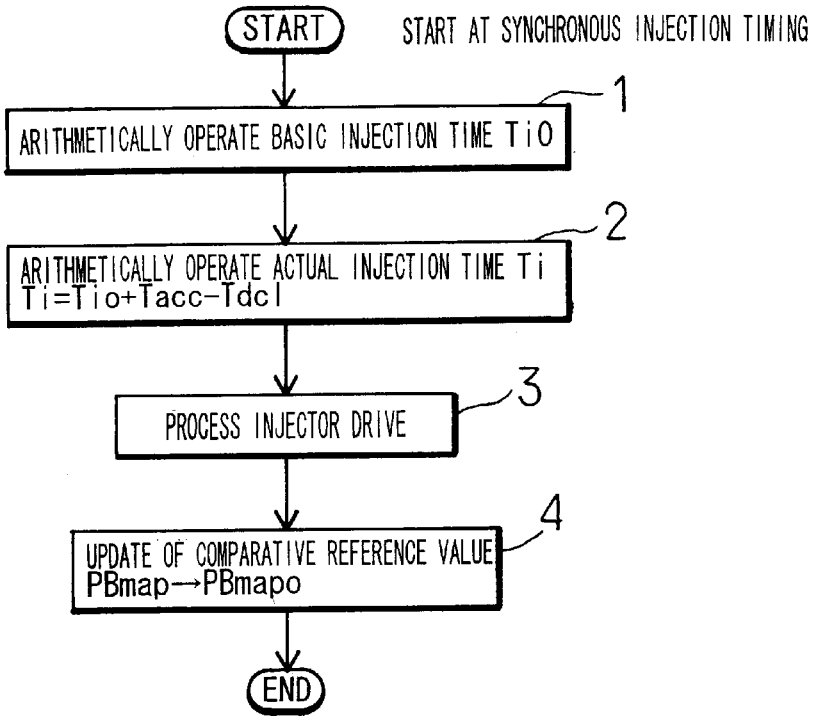
FIG. 6 is a flowchart showing an algorithm for an interruption routine which is run by a microcomputer when a pulser coil generates a reference pulse signal in an embodiment of the present invention.
Figure 7:
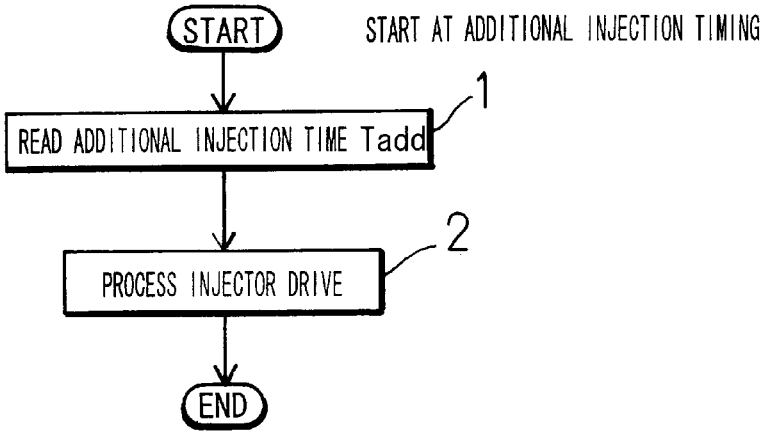
FIG. 7 is a flowchart showing an algorithm for an interruption routine which is run when an additional injection timing is detected in an embodiment of the present invention.

FIGS. 5 to 7 are flowcharts showing examples of algorithms constituting important parts of a program executed by the microcomputer in order to comprise respective means for achieving the above described functions of the fuel injection control apparatus shown in FIG. 4. FIG. 5 shows a program for task which is repeatedly carried out at very close time intervals Δt, and FIG. 6 shows a program of an interruption routine which is run when the pulser coil 6*a* generates the reference pulse (at the synchronous injection timing) immediately before an intake stroke of the engine (at the end of the exhaust stroke). In addition, FIG. 7 shows an interruption routine which is run at the additional injection timing.

The rotational speed detection means 11, the intake air amount arithmetical operation means 12, the basic injection time arithmetical operation means 13, and the actual injection arithmetical operation means 15 shown in FIG. 4 are achieved by an main routine or other tasks, but a flowchart of an algorithm for the main routine is not shown because the processing for achieving these function achieving means by the main routine is the same as the conventional processing.

If an algorithm shown in this figure is used, a task shown in FIG. 5 is carried out at constant time intervals Δt. The time intervals for carrying out the task shown in FIG. 5 is set at about 2-msec. intervals for example. Firstly, according to Step 1 of the task as shown in FIG. 5, a map retrieval value PBmap on the intake pressure map is obtained based on the rotational speed of the engine detected by the rotational speed detection means 11 and the throttle valve opening degree detected by the throttle sensor 4, and then a map retrieval value variation ΔPBmap is arithmetically operated by subtracting a comparative reference value PBmap0 from the map retrieval value PBmap. As the comparative reference value PBmap0, a retrieval value PBmap which has searched at a timing immediately before the previous synchronous injection timing is used. In this embodiment, a timing where the reference pulse generated by the pulser coil 6*a* before starting an intake stroke (at the end of the exhaust stroke) is recognized is considered as the synchronous injection timing, as described above.

After arithmetically operating the map retrieval value variation ΔPBmap as described above, whether the ΔPBmap is positive or negative is determined at Step 2, and consequently, if it is determined that ΔPBmap>0 (if it is determined that the load changes to be increased), whether or not the ΔPBmap exceeds a set value a is determined at Step 3. If it is determined that ΔPBmap>α, the process proceeds to Step 4, where it is determined whether or not a rotational speed N detected by the rotational speed detection means 11 is equal to or less than a correction permitting (increment permitting) rotational speed Na. As a result of this determination, if it is determined that the rotational speed N is not more than the correction permitting rotational speed Na (if it is determined that the rotational speed of the engine is within a range where the fuel quantity is required to be increased), the process proceeds to Step 5 where it is determined whether or not the throttle valve opening degree θ is equal to or more than a correction permitting (increment permitting) throttle valve opening degree θa. If it is determined that the throttle valve opening degree θ is not less than a correction permitting throttle valve opening degree θa, the process proceeds to Step 6, where an increment correction amount Tacc to be added to the basic injection time is arithmetically operated for performing the increment correction.

After arithmetically operating the increment correction amount Tacc at Step 6, a decrement correction amount Tdcl arithmetically operated at another step for decreasing the injection quantity is cleared at Step 7 (a value of Tdcl is set to be zero).

If it is determined that ΔPBmap≦α (if it is determined that the load on the engine is not increased to an extent that the fuel quantity is required to be increased) at Step 3, if it is determined that the rotational speed N exceeds the correction permitting rotational speed Na at Step 4, and if it is determined that the throttle valve opening degree θ is less than the correction permitting throttle valve opening degree θa at Step 5, the process proceeds to Step 8, where the increment correction amount Tacc and the decrement correction amount Tdcl which has been determined at another step are cleared (values of Tacc and Tdcl are set to be zero, respectively).

After Step 7 or Step 8, the process proceeds to Step 9, where it is determined whether or not the map retrieval value variation ΔPBmap exceeds a preset additional injection determination value A. As a result of the determination, if it is determined that the map retrieval value variation ΔPBmap exceeds the additional injection determination value A, the process proceeds to Step 10, where it is determined that the rotational speed N is not more than an additional injection permitting rotational speed Nc. If it is determined that the rotational speed N is not more than the additional injection permitting rotational speed Nc, the process proceeds to Step 11, where it is determined that whether or not the throttle valve opening degree θ is equal to or more than an additional injection permitting throttle valve opening degree θc. As a result of the determination, if it is determined that the throttle valve opening degree θ is not less than the additional injection permitting throttle valve opening degree θc, an additional injection time Tadd is arithmetically operated at Step 12, then this task is completed. The arithmetical operation of the additional injection time Tadd can be performed as follows. That is, a map for an additional injection time arithmetical operation which provides a relation among a map retrieval value variation ΔPBmap, an intake pipe pressure P detected during the previous intake stroke, and an additional injection time is prepared, then the map is searched for the map retrieval value variation ΔPBmap and the intake pipe pressure P detected during the previous intake stroke.

If it is determined that the map retrieval value variation ΔPBmap is not more than the set additional injection determination value A at Step 9, if it is determined that the rotational speed N exceeds the additional injection permitting rotational speed Nc at Step 10, and if it is determined that the throttle valve opening degree θ is less than the additional injection permitting throttle valve opening degree θc at Step 11, the process proceeds to Step 13 where the additional injection time Tadd is cleared (a value of Tadd is set to be zero), then this task is completed.

If it is determined that the map retrieval value variation ΔPBmap is negative (if it is determined that a load on the engine changes to be decreased) at Step 2, the process proceeds to Step 4 where it is determined that whether or not the map retrieval value variation ΔPBmap (a negative value) is smaller than a set value αb (whether or not an absolute value of the map retrieval value variation is larger than the set value αb). As a result of the determination, if it is determined that ΔPBmap<αb, the process proceeds to Step 15 where it is determined whether or not the rotational speed N is not less than a correction permitting rotational speed (decrement permitting) Nb. As a result of the determination, if it is determined that the rotational speed N is not less than the correction permitting rotational speed Nb, it is determined that whether or not the throttle valve opening degree θ is not less than the correction permitting throttle valve opening degree θb at Step 16. If it is determined that the throttle valve opening degree θ is not less than the correction permitting throttle valve opening degree θb, the process proceeds to Step 17 where an decrement correction amount Tdcl to be subtracted from the basic injection time is arithmetically operated for decreasing the injection quantity.

After arithmetically operating the decrement correction amount Tdcl at Step 17, the increment correction amount Tacc arithmetically operated at Step 6 and the additional injection time Tadd arithmetically operated at Step 12 for increasing the injection quantity are cleared (values of Tacc and Tadd are set to be zero, respectively) at Step 18, then this task is completed.

If it is determined that ΔPBmap≧αb (if it is determined that a load on the engine does not decreases to an extent that the fuel quantity is required to be decreased) at Step 14, if it is determined that the rotational speed N is lower than the correction permitting rotational speed Nb at Step 15, and if it is determined that the throttle valve opening degree θ is less than the correction permitting throttle valve opening degree θb at Step 16, the process proceeds to Step 19, where the increment correction amount Tacc, the decrement correction amount Tdcl, and the additional injection time Tadd are cleared (values of Tacc, Tdcl, and Tadd are set to be zero, respectively), then this task is completed.

According to Step 1 of the example shown in FIG. 5, the map retrieval means 14C which obtains a retrieval value on an intake pressure map (a parameter map for detecting a load) based on a throttle valve opening degree of the engine and a rotational speed of the engine, and the map retrieval value variation arithmetical operation means 14D which uses a map retrieval value obtained by searching the map at a timing immediately before the previous synchronous injection timing as a comparative reference value and arithmetically operates a difference between a newly obtained map retrieval value by searching the map and the comparative reference value as a map retrieval value variation are achieved.

According to Step 2 to Step 6, increment correction variable arithmetical operation means is achieved, where a correction amount for increasing the fuel injection quantity (a correction amount, in this example) is arithmetically operated based on a map retrieval value variation when a sign of the map retrieval value variation ΔPBmap is positive and a magnitude of the variation exceeds a set value and when the rotational speed is not more than an increment permitting rotational speed and the throttle valve opening degree is not less than the increment permitting throttle valve opening degree.

Further, according to Step 2 and Steps 14 to 17, decrement correction variable arithmetical operation means is achieved, where a correction amount for decreasing the fuel injection quantity (a correction amount, in this example) is arithmetically operated based on a map retrieval value variation when a sign of the map retrieval value variation ΔPBmap is negative and a magnitude of the variation exceeds a set value and when the rotational speed is not less than a decrement permitting rotational speed and the throttle valve opening degree is not less than a decrement permitting throttle valve opening degree.

The above described increment correction variable arithmetical operation means and decrement correction variable arithmetical operation means constitute correction variable arithmetical operation means where, if it is determined from a sign of the map retrieval value variation that the internal combustion engine is in an accelerated condition, the correction variable is arithmetically operated only when the throttle valve opening degree is not less than a predetermined correction permitting throttle valve opening degree and a magnitude of the map retrieval value variation exceeds a set value and when the rotational speed is less than the increment permitting rotational speed, and if it is determined from a sign of the map retrieval value variation that the internal combustion engine is in a decelerated condition, the above described correction variable is arithmetically operated only when a magnitude of the map retrieval value variation is less than the set value and the throttle valve opening degree exceeds the predetermined correction permitting throttle valve opening degree and when the rotational speed is not less than the increment permitting rotational speed.

In the fuel injection control apparatus of this embodiment, an interruption routine shown in FIG. 6 is run when the pulser coil 6*a* generates the reference pulse Vp1 at the end of the exhaust stroke of the engine (when the synchronous injection timing is detected).

The pulser coil 6*a* generates one pulse signal Vp1 and one pulse signal Vp2 while the crankshaft of the engine is rotated by a single turn, so that it is necessary to identify when (during operation of the engine) a series of pulse signals are generated by the pulser coil, for the purpose of using a timing where the reference pulse Vp1 is generated as the synchronous injection timing. In order to identify the reference pulse, a first reference pulse which is generated after the intake pipe pressure of the engine becomes a minimum value may be identified as a reference pulse which is generated immediately before an extension stroke and then the subsequent reference pulse which is generated after the above described reference pulse may be identified as a reference pulse which is generated immediately before an intake stroke, for example. If a cam axis sensor, which generates pulse signals having positive and negative polarities one time while the cam axis is rotated by a single turn, is provided, it is possible to identify an output pulse from the pulser coil by using an output pulse from this cam axis sensor as a reference for the identification.

Firstly, according to Step 1 in the interruption routine shown in FIG. 6, a basic injection time Ti0 is arithmetically operated by using an intake air amount which is arithmetically operated based on an intake pipe pressure detected during the previous intake stroke, a rotational speed of the engine, and a volumetric efficiency, and a detection value of the control conditions such as an intake temperature of the engine and a cooling water temperature. This basic injection time Ti0 is an injection time in a steady state where it is not necessary to increase or decrease the fuel injection quantity.

At Step 2, the basic injection time and the correction amounts Tacc and Tdcl arithmetically operated immediately before this process are used to perform the addition and subtraction, then an actual injection time (Ti=Ti0+Tacc−Tdcl) is arithmetically operated. When an accelerating operation or decelerating operation of the engine does not performed or when the throttle valve opening degree is substantially constant and the load does not change significantly (when driving on a leveled ground, for example), values of the correction amounts Tacc and Tdcl become zero, respectively. Therefore, the actual injection time becomes equal to the basic injection time.

After arithmetically operating the actual injection time, an injection command signal Vj whose signal width corresponds to the additional injection time is provided to the injector drive circuit to perform processing of an injector drive which allows the injector 2 to inject fuel at Step 3. This processing of the injector drive is performed by inputting the actual injection time Ti to an injection timer and providing the injection command pulse Vj to the injector drive circuit while the timer is measuring the actual injection time Ti.

After the processing of the injector drive, the comparative reference value PBmap0 is updated at Step 4 and then the interruption routine shown in FIG. 6 is completed.

In this example, the basic injection time arithmetical operation 13 is achieved by Step 1 of FIG. 6, and the actual injection time arithmetical operation means 15 is achieved by Step 2 of FIG. 6. Further, the synchronous injection processing means 16 is achieved by Step 3 of the FIG. 6.

Although the injector is driven after arithmetically operating the basic injection time Ti0 and the actual injection time Ti at the synchronous injection timing (when the reference pulse signal is generated) in the example shown in FIG. 6, it is also possible that the injection timer is firstly started at the synchronous timing and simultaneously a driving current is supplied to the injector, then the basic injection time Ti0 and the actual injection time Ti are arithmetically operated, and when the measurement value of the injection timer becomes equal to the arithmetically operated actual injection time Ti, supplying of the driving current to the injector is terminated.

In the embodiment shown in FIG. 4, an interruption routine shown in FIG. 7 is run when the additional injection timing detection means 22 detects an additional injection timing. According to Step 1 of this interruption routine, the additional injection time Tadd arithmetically operated at Step 12 of FIG. 5 is read, then the processing of the injector drive is performed at Step 2. This processing of the injector drive is performed by inputting the additional injection time Tadd to an injection timer and providing the additional injection command pulse Vja to the injector drive circuit while the timer is measuring the additional injection time Tadd.

In this embodiment, the additional injection time arithmetical operation means 23, which arithmetically operates the additional injection time Tadd when the map retrieval value variation ΔPBmap arithmetically operated by the map value variation arithmetical operation means at the additional injection timing and the immediately preceding timing exceeds a preset additional injection determination value A, is achieved by Step 9 to Step 12 of FIG. 5, and the additional injection processing means 24 is comprised of the interruption routine shown in FIG. 7.

In the fuel injection control apparatus according to the present invention, if only the synchronous injection is performed without performing the additional injection (the construction is the same as that shown in FIG. 2), it is possible to omit Steps 9 to 13 in the task of FIG. 5 and complete the task after Step 7. In this case, the interruption routine shown in FIG. 7 is omitted.

According to the task shown in FIG. 5, if it is determined from a sign of the map retrieval value variation that the internal combustion engine is in an acceleration state, the correction valuable is arithmetically operated only when the throttle valve opening degree is not less than a predetermined correction permitting throttle valve opening degree and a magnitude of the map retrieval value variation exceeds a set value and when the rotational speed is less than the increment permitting rotational speed, and if it is determined from a sign of the map retrieval value variation that the internal combustion engine is in a deceleration state, the correction valuable is arithmetically operated only when a magnitude of the map retrieval value variation is less than the set value and the throttle valve opening degree exceeds the predetermined correction permitting throttle valve opening degree and when the rotational speed is not less than the increment permitting rotational speed. However, it is possible to perform the arithmetical operation of the correction valuable when a magnitude of the map retrieval value variation exceeds the set value, without the determination of the rotational speed or the throttle valve opening degree. In this case, Steps 4, 5, 10, 11, 15, and 16 in the task of FIG. 5 are omitted.

When the correction valuable is arithmetically operated, it is also possible to perform determination whether or not a magnitude of the map retrieval value variation exceeds the set value and any one of determination of the rotational speed and determination of the throttle valve opening degree. In this case, Steps 4, 10, and 15 or Steps 5, 11, and 16 in the task of FIG. 5 are omitted.

In the above description, a minimum value of an intake pipe pressure is used as a parameter for detecting the load, but the parameter for detecting the load may be a parameter which varies depending on a change in the load applied to the engine. Therefore, this parameter is not limited to the intake pipe pressure.

For example, instead of the intake pipe pressure, the basic injection time of fuel arithmetically operated based on the rotational speed of the engine and the throttle valve opening degree may also be used as the load detecting parameter. In this case, a basic injection time map based on the throttle valve opening degree and speed, which provide a relation among the throttle valve opening degree, the rotational degree, and the basic injection time, is used as a load detecting parameter map.

Further, an output torque at a time of steady operation of the engine arithmetically operated based on the rotational speed of the engine and the throttle valve opening degree may also be used as the load detecting parameter. In this manner, if the output torque of the engine is used as the load detecting parameter, torque map storing means for storing a torque map which provides a relation among the throttle valve opening degree, the rotational speed of the engine, and the output torque of the engine and torque map retrieval means for obtaining a retrieval value on the torque map based on the throttle valve opening degree and the rotational speed are provided, and the retrieval value on the torque map is used as the load detecting parameter.

The above described embodiment, which uses an intake pipe pressure (if the intake pipe pressure has a minimum value, the minimum value is used) as the load detecting parameter, may be also provided with a fail-safe function for preventing a vehicle from becoming out of control under the fault condition of the intake pressure sensor by programming a control program such that the basic injection time is arithmetically operated by using the retrieval value on the intake pressure map, instead of the intake pipe pressure obtained from an output of the intake pressure sensor, when a detection signal of an intake pipe pressure can not be obtained from the intake pressure sensor due to a failure of the intake pressure sensor.

In the above described embodiment, arithmetical operations of the map retrieval value, the map retrieval value variation, and the correction variable are repeatedly performed at very close time intervals. However, it is also possible to continuously perform arithmetical operations of the map retrieval value, the map retrieval value variation, the correction variable, and the actual injection time when the synchronous injection timing is detected without repeatedly performing these arithmetical operations.

Similarly, it is also possible to continuously perform arithmetical operations of the map retrieval value, the map retrieval value variation, and the additional injection time when the additional injection timing is detected.

Although the electronic fuel injection control apparatus for the four-cycle single cylinder internal combustion engine, to which the present invention is applied, has been described by way of example, the present invention can undoubtedly be applied to an electronic fuel injection apparatus for a four-cycle multi-cylinder internal combustion engine. If the present invention is applied to a fuel injection control apparatus for the multi-cylinder internal combustion engine, a load detecting parameter map may be provided commonly for all cylinders, and a correction coefficient of a fuel injection time for each cylinder may be arithmetically operated relative to a variation $\Delta$PBmap of a retrieval value on the common load detecting parameter map.

Further, the above described embodiment uses the correction amount to be added to or subtracted from the basic injection time as the correction variable, but an increment correction coefficient Kacc ($\geqq 1$) or a decrement correction coefficient Kdcl ($\leqq 1$) by which the basic injection time is multiplied may also be used as the correction coefficient.

According to the present invention as described above, a load detecting parameter map which provides a relation among a load detecting parameter varying with a change in the load on the engine, a rotational speed, and a throttle valve opening degree is prepared, a retrieval value on this map is obtained based on the rotational speed and the throttle valve opening degree, a map retrieval value variation which reflects a varying condition of the load on the engine produced during a time period from the previous synchronous injection timing to the present synchronous injection timing is determined, and a correction variable which is arithmetically operated relative to on the map retrieval value variation is used to correct the basic injection time in order to determine an actual injection time. Therefore, it is possible to prevent an air-fuel ratio of a gaseous mixture from becoming leaner or richer due to excess and deficiency of a fuel injection quantity caused by a delay in detection of an intake air amount at a time of accelerating or decelerating the engine and at a time of increasing or decreasing the load.

Further, according to the present invention, even if the throttle valve opening degree is constant while the load is increased or decreased, the correction variable for precisely performing the increment correction or decrement correction can be arithmetically operated by detecting the increase of decrease in the load based on the map retrieval value variation. Therefore, it is possible to precisely correct the fuel injection quantity even if the throttle valve opens slowly as in the case of climbing run of the engine or the load is suddenly decreased due to some reasons during the driving.

Further, according to the present injection, the increment correction which is commensurate with the varying condition of the load on the engine immediately before the synchronous injection timing can be performed. Therefore, it is possible to precisely correct the injection quantity even if the accelerating operation of the engine is performed in a light-load state, the accelerating operation is performed in a high-load state, or the abrupt decelerating operation is performed.

Still further, according to the present invention, the correction variable which is commensurate with the load on the engine at the moment is arithmetically operated at every synchronous injection timing. Therefore, it is possible to prevent the air-fuel ratio from becoming leaner due to deficiency in the fuel injection quantity, when the throttle valve opening degree is gradually increased at the beginning of acceleration and subsequently the opening degree is sharply increased at any point during the acceleration.

Still further, according to the present invention, if the asynchronous injection is performed in addition to the synchronous injection, the deficiency of the fuel is immediately made up even when the fuel becomes insufficient due to an increase in the load on the engine during the intake stroke after the synchronous injection. Therefore, it is possible to prevent the air-fuel ratio from becoming leaner due to deficiency in the fuel injection quantity caused by the increase in the load after the synchronous injection.

In the present invention, if the asynchronous injection is performed in addition to the synchronous injection, the deficiency of the fuel is made up at a timing immediately before a timing where the intake stroke is completed. Therefore, it is possible to more precisely control the injection quantity in order to maintain the air-fuel ratio within a proper range against the variation of the loaded condition of the engine.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. An electronic fuel injection control apparatus for controlling a quantity of fuel injected from an injector into an intake pipe of an internal combustion engine, comprising:

intake air amount arithmetical operation means for arithmetically operating an intake air amount from an intake pipe pressure of said internal combustion engine and a rotational speed of the internal combustion engine;

basic injection time arithmetical operation means for arithmetically operating a basic injection time of the fuel based on said intake air amount;

correction variable arithmetical operation means for arithmetically operating a correction variable which is used for determining an actual injection time by performing a correction operation on said basic injection time;

synchronous injection control means for performing an actual injection time processing in which the actual injection time is arithmetically operated by performing said correction operation using the correction variable arithmetically operated by said correction variable arithmetical operation means at every time a predetermined synchronous injection timing is detected and for performing a processing in which the synchronous injection is effected by actuating said injector during the arithmetically operated actual injection time;

load detecting parameter map storing means for storing a load detecting parameter map which provides a relation among a load detecting parameter which varies depending on a change in a load applied to said internal combustion engine, an throttle valve opening degree of said internal combustion engine, and a rotational speed of said internal combustion engine;

map retrieval means for arithmetically operating a map retrieval value on said load detecting parameter map, based on the throttle valve opening degree of said internal combustion engine and the rotational speed of said internal combustion engine, at least at each synchronous injection timing or at the immediately preceding timing; and map retrieval value variation arithmetical operation means in which, at every time the map retrieval value is arithmetically operated by said map retrieval means, the map retrieval value arithmetically operated by said map retrieval means at the previous synchronous injection timing or at the immediately preceding timing is used as a comparative reference value and a difference between a map retrieval value newly obtained by the map retrieval means and said comparative reference value is arithmetically operated as a map retrieval value variation, wherein said correction variable arithmetical operation means is comprised such that said correction variable is arithmetically operated relative to the map retrieval value variation when said map retrieval value variation arithmetically operated at said synchronous injection timing or the immediately preceding timing exceeds a set value, and wherein said synchronous injection control means is comprised such that said actual injection time processing is performed by using the correction variable arithmetically operated by said correction variable arithmetical operation means at said synchronous injection timing or the immediately preceding timing.

2. The electronic fuel injection control apparatus according to claim 1, wherein said map retrieval means is comprised such that the arithmetical operation of said map retrieval value is repeatedly performed at very close time intervals during every stroke of said internal combustion engine.

3. The electronic fuel injection control apparatus according to claim 1, wherein said map retrieval means is comprised such that the arithmetical operation of said map retrieval value is performed only when said synchronous injection timing is detected.

4. The electronic fuel injection control apparatus according to claim 1, wherein the intake pipe pressure of said internal combustion engine is used as said load detecting parameter, and wherein an intake pressure map which provides a relation among the throttle valve opening degree, the rotational speed, and the intake pipe pressure of said internal combustion engine is used as said load detecting parameter map.

5. The electronic fuel injection control apparatus according to claim 1, wherein the basic injection time of said fuel is used as said load detecting parameter, and wherein a basic injection time map which provides a relation among said throttle valve opening degree, the rotational speed, and said basic injection time is used as said load detecting parameter map.

6. The electronic fuel injection control apparatus according to claim 1, wherein an output torque of said internal combustion engine is used as said load detecting parameter, and wherein a torque map which provides a relation among said throttle valve opening degree, said rotational speed, and said output torque of the internal combustion engine is used as said load detecting parameter map.

7. The electronic fuel injection control apparatus according to claim 1, wherein said correction variable arithmetical operation means is comprised such that the arithmetical operation of said correction variable is performed only when a magnitude of said map retrieval value variation exceeds a set value and said throttle valve opening degree exceeds a predetermined correction permitting throttle valve opening degree.

8. The electronic fuel injection control apparatus according to claim 1, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than an increment permitting rotational speed, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than a decrement permitting rotational speed.

9. The electronic fuel injection control apparatus according to claim 1, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than the increment permitting rotational speed and said throttle valve opening degree is not less than a predetermined increment permitting throttle valve opening degree, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than the decrement permitting rotational speed and said throttle valve opening degree is not less than a predetermined decrement permitting throttle valve opening degree.

10. The electronic fuel injection control apparatus according to claim 1, wherein said correction variable is a correction coefficient by which said basic injection time is multiplied.

11. The electronic fuel injection control apparatus according to claim 1, wherein said correction variable is a correction amount which is added to or subtracted from said basic injection time.

12. An electronic fuel injection control apparatus for controlling a quantity of fuel injected from an injector into an intake pipe of an internal combustion engine, comprising:

intake air amount arithmetical operation means for arithmetically operating an intake air amount from an intake pipe pressure of said internal combustion engine and a rotational speed of the internal combustion engine;

basic injection time arithmetical operation means for arithmetically operating a basic injection time of the fuel based on said intake air amount;

correction variable arithmetical operation means for arithmetically operating a correction variable which is used for determining an actual injection time by performing a correction operation on said basic injection time;

synchronous injection control means for performing an actual injection time processing in which the actual injection time is arithmetically operated by performing said correction operation using the correction variable arithmetically operated by said correction variable arithmetical operation means at every time a predetermined synchronous injection timing is detected and for performing a processing in which the synchronous injection is effected by actuating said injector during the arithmetically operated actual injection time;

load detecting parameter map storing means for storing a load detecting parameter map which provides a relation among a load detecting parameter which varies depending on a change in a load applied to said internal combustion engine, an throttle valve opening degree of said internal combustion engine, and a rotational speed of said internal combustion engine;

map retrieval means for arithmetically operating a map retrieval value on said load detecting parameter map, based on the throttle valve opening degree of said internal combustion engine and the rotational speed of said internal combustion engine, at least at each synchronous injection timing or at the immediately preceding timing;

map retrieval value variation arithmetical operation means in which, at every time the map retrieval value is arithmetically operated by said map retrieval means, the map retrieval value arithmetically operated by said map retrieval means at the previous synchronous injection timing or at the immediately preceding timing is used as a comparative reference value and a difference between a map retrieval value newly obtained by the map retrieval means and said comparative reference value is arithmetically operated as a map retrieval value variation;

asynchronous injection permitting crank angle determination means for determining whether or not the present crank angle position of said internal combustion engine is at a crank angle position where the asynchronous injection is permitted;

asynchronous injection time arithmetical operation means for arithmetically operating an asynchronous injection time which is required for making up for a deficiency of the fuel when it is detected that the fuel is insufficient after the beginning of the synchronous injection; and asynchronous injection processing means for actuating said injector in order to inject the fuel during the arithmetically operated asynchronous injection time, when said asynchronous injection time arithmetical operation means arithmetically operates the asynchronous injection time after completing said synchronous injection and when it is detected by said asynchronous injection permitting crank angle determination means that the present crank angle position is at a position permitting the asynchronous injection, wherein said map retrieval means is comprised such that the map retrieval values are arithmetically operated repeatedly at very close time intervals during a time period where said asynchronous injection is permitted at least after completing said synchronous injection, and said map retrieval values are arithmetically operated at least at the synchronous injection timing or at the immediately preceding timing during the other time of period, said correction variable arithmetical operation means is comprised such that the arithmetical operation of said correction variable is performed relative to the map retrieval value variation when said map retrieval value variation arithmetically operated at said synchronous injection timing or at the immediately preceding timing exceeds a set value, said synchronous injection control means is comprised such that said actual injection time processing is performed by using the correction variable which is arithmetically operated by said correction variable arithmetical operation means at said synchronous injection timing or at the immediately preceding timing, and said asynchronous injection time processing means is comprised such that said asynchronous injection time is arithmetically operated when it is detected that said map retrieval value variation arithmetically operated at very close time intervals reaches a preset asynchronous determination value.

13. The electronic fuel injection control apparatus according to claim 12, wherein said map retrieval means is comprised such that the arithmetical operation of said map retrieval value is repeatedly performed at very close time intervals during every stroke of said internal combustion engine.

14. The electronic fuel injection control apparatus according to claim 12, wherein the intake pipe pressure of said internal combustion engine is used as said load detecting parameter, and wherein an intake pressure map which provides a relation among the throttle valve opening degree, the rotational speed, and the intake pipe pressure of said internal combustion engine is used as said load detecting parameter map.

15. The electronic fuel injection control apparatus according to claim 12, wherein the basic injection time of said fuel is used as said load detecting parameter, and wherein a basic injection time map which provides a relation among said throttle valve opening degree, the rotational speed, and said basic injection time is used as said load detecting parameter map.

16. The electronic fuel injection control apparatus according to claim 12, wherein an output torque of said internal combustion engine is used as said load detecting parameter, and wherein a torque map which provides a relation among said throttle valve opening degree, said rotational speed, and said output torque of the internal combustion engine is used as said load detecting parameter map.

17. The electronic fuel injection control apparatus according to claim 12, wherein said correction variable arithmetical operation means is comprised such that the arithmetical operation of said correction variable is performed only when a magnitude of said map retrieval value variation exceeds a set value and said throttle valve opening degree exceeds a predetermined correction permitting throttle valve opening degree.

18. The electronic fuel injection control apparatus according to claim 12, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than an increment permitting rotational speed, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than a decrement permitting rotational speed.

19. The electronic fuel injection control apparatus according to claim 12, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than the increment permitting rotational speed and said throttle valve opening degree is not less than a predetermined increment permitting throttle valve opening degree, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than the decrement permitting rotational speed and said throttle valve opening degree is not less than a predetermined decrement permitting throttle valve opening degree.

20. The electronic fuel injection control apparatus according to claim 12, wherein said correction variable is a correction coefficient by which said basic injection time is multiplied.

21. The electronic fuel injection control apparatus according to claim 12, wherein said correction variable is a correction amount which is added to or subtracted from said basic injection time.

22. An electronic fuel injection control apparatus for controlling a quantity of fuel injected from an injector into an intake pipe of an internal combustion engine, comprising:

intake air amount arithmetical operation means for arithmetically operating an intake air amount from an intake pipe pressure of said internal combustion engine and a rotational speed of the internal combustion engine;

basic injection time arithmetical operation means for arithmetically operating a basic injection time of the fuel based on said intake air amount;

correction variable arithmetical operation means for arithmetically operating a correction variable which is used for determining an actual injection time by performing a correction operation on said basic injection time;

synchronous injection control means for performing an actual injection time processing in which the actual injection time is arithmetically operated by performing said correction operation using the correction variable arithmetically operated by said correction variable arithmetical operation means at every time a predetermined synchronous injection timing is detected and for performing a processing in which the synchronous injection is effected by actuating said injector during the arithmetically operated actual injection time;

load detecting parameter map storing means for storing a load detecting parameter map which provides a relation among a load detecting parameter which varies depending on a change in a load applied to said internal combustion engine, an throttle valve opening degree of said internal combustion engine, and a rotational speed of said internal combustion engine;

additional injection timing detection means for detecting an additional injection timing which is set at the end of an intake stroke of said internal combustion engine;

map retrieval means for arithmetically operating a map retrieval value on said load detecting parameter map, based on the throttle valve opening degree of said internal combustion engine and the rotational speed of said internal combustion engine, at least at said synchronous injection timing or at the immediately preceding timing and at said additional injection timing or at the immediately preceding timing;

map retrieval value variation arithmetical operation means in which, at every time the map retrieval value is arithmetically operated by said map retrieval means, the map retrieval value arithmetically operated by said map retrieval means at the previous synchronous injection timing or at the immediately preceding timing is used as a comparative reference value and a difference between a map retrieval value newly obtained by the map retrieval means and said comparative reference value is arithmetically operated as a map retrieval value variation;

additional injection time arithmetical operation means for arithmetically operating an additional injection time required for making up for a deficiency of the fuel after the beginning of said synchronous injection relative to the map retrieval value variation when the latest map retrieval value variation arithmetically operated by said map retrieval value variation arithmetical operation means exceeds a preset additional injection determination value; and additional injection processing means for performing a processing in which the fuel is additionally injected from said injector during the additional injection time arithmetically operated by said additional injection time arithmetical operation means when said additional injection timing is detected, wherein said correction variable arithmetical operation means is comprised such that the arithmetical operation of said correction variable is performed relative to the map retrieval value variation when said map retrieval value variation arithmetically operated at said synchronous injection timing or at the immediately preceding timing exceeds a set value, said actual injection time arithmetical operation means is comprised such that said actual injection time is arithmetically operated by using the correction variable arithmetically operated by said correction variable arithmetical operation means at the synchronous injection timing or at the immediately preceding timing, and said additional injection timing is set to be a timing before a timing, where the intake stroke of said internal combustion engine is completed such that the additionally injected fuel flows into a cylinder of said internal combustion engine.

23. The electronic fuel injection control apparatus according to claim 22, wherein said additional injection time arithmetical operation means is comprised such that the additional injection time is arithmetically operated only when said map retrieval value variation exceeds said additional injection determination value and said rotational speed is less than a set rotational speed and the throttle valve opening degree is not less than the additional injection determination value.

24. The electronic fuel injection control apparatus according to claim 22, wherein said map retrieval means is comprised such that the arithmetical operation of said map retrieval value is repeatedly performed at very close time intervals during every stroke of said internal combustion engine.

25. The electronic fuel injection control apparatus according to claim 22, wherein said map retrieval means is comprised such that said map retrieval value is arithmetically operated only when said synchronous injection timing is detected and said additional injection timing is detected.

26. The electronic fuel injection control apparatus according to claim 22, wherein the intake pipe pressure of said internal combustion engine is used as said load detecting parameter, and wherein an intake pressure map which provides a relation among the throttle valve opening degree, the rotational speed, and the intake pipe pressure of said internal combustion engine is used as said load detecting parameter map.

27. The electronic fuel injection control apparatus according to claim 22, wherein the basic injection time of said fuel is used as said load detecting parameter, and wherein a basic injection time map which provides a relation among said throttle valve opening degree, the rotational speed, and said basic injection time is used as said load detecting parameter map.

28. The electronic fuel injection control apparatus according to claim 22, wherein an output torque of said internal combustion engine is used as said load detecting parameter, and wherein a torque map which provides a relation among said throttle valve opening degree, said rotational speed, and said output torque of the internal combustion engine is used as said load detecting parameter map.

29. The electronic fuel injection control apparatus according to claim 22, wherein said correction variable arithmetical operation means is comprised such that the arithmetical operation of said correction variable is performed only when a magnitude of said map retrieval value variation exceeds a set value and said throttle valve opening degree exceeds a predetermined correction permitting throttle valve opening degree.

30. The electronic fuel injection control apparatus according to claim 22, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than an increment permitting rotational speed, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than a decrement permitting rotational speed.

31. The electronic fuel injection control apparatus according to claim 22, wherein said correction variable arithmetical operation means is comprised such that if it is determined from a sign of said map retrieval value variation that the load on said internal combustion engine changes to be increased, the arithmetical operation of said correction variable is performed only when a magnitude of said map retrieval value variation exceeds the set value and said rotational speed is less than the increment permitting rotational speed and said throttle valve opening degree is not less than a predetermined increment permitting throttle valve opening degree, and if it is determined from a sign of said map retrieval value variation that the load on said internal combustion engine changes to be decreased, the arithmetical operation of said correction variable is performed only when a magnitude of said map retrieval value variation exceeds the set value and said rotational speed is not less than the decrement permitting rotational speed and said throttle valve opening degree is not less than a predetermined decrement permitting throttle valve opening degree.

32. The electronic fuel injection control apparatus according to claim 22, wherein said correction variable is a correction coefficient by which said basic injection time is multiplied.

33. The electronic fuel injection control apparatus according to claim 22, wherein said correction variable is a correction amount which is added to or subtracted from said basic injection time.

* * * * *

UNITED STATES PATENT AND TRADEMARK OFFICE

CERTIFICATE OF CORRECTION

PATENT NO. : 6,550,457 B1
DATED : April 22, 2003
INVENTOR(S) : Kitagawa et al.

It is certified that error appears in the above-identified patent and that said Letters Patent is hereby corrected as shown below:

Column 26,
Line 57, delete "value a" and insert -- value α --.

Column 28,
Line 4, delete "value αb" and insert -- value -αb --.
Line 7, delete "ΔPBmap<αb" and insert -- ΔPBmap<-αb --.
Line 28, ΔPBmap≥αb" and insert -- ΔPBmap≥-αb --.

Signed and Sealed this

Seventeenth Day of June, 2003

JAMES E. ROGAN
*Director of the United States Patent and Trademark Office*